United States Patent [19]

Katayama et al.

[11] Patent Number: 4,662,937

[45] Date of Patent: May 5, 1987

[54] PROCESS FOR PRODUCTION OF HIGH-MANGANESE IRON ALLOY BY SMELTING REDUCTION

[75] Inventors: Hiroyuki Katayama; Hidetake Ishikawa; Masatoshi Kuwabara; Hiroyuki Kajioka, Masaki Fujita, all of Kitakyusyushi; Kenji Shibata, Tokyo; Yoshiaki Tamura, Tokyo; Takashi Shimanuki, Tokyo, all of Japan

[73] Assignees: Nippon Steel Corporation; Japan Metals and Chemicals Co., Ltd., both of Tokyo, Japan

[21] Appl. No.: 737,406

[22] Filed: May 24, 1985

[30] Foreign Application Priority Data

May 28, 1984 [JP] Japan ..... 59-108143
Jun. 18, 1984 [JP] Japan ..... 59-124798
Jul. 16, 1984 [JP] Japan ..... 59-145966

[51] Int. Cl.[4] ..... C22B 47/00

[52] U.S. Cl. ..... 75/80; 420/434; 420/581; 420/72

[58] Field of Search ..... 75/80, 133.5, 40, 21, 75/58; 420/581, 434

[56] References Cited

U.S. PATENT DOCUMENTS 3,240,591 3/1966 Keyser ..... 75/80
3,305,352 2/1967 Day ..... 75/59.12
4,130,417 12/1978 Brever et al. ..... 75/80
4,274,871 6/1981 Demange et al. ..... 75/80

*Primary Examiner*—Melvyn J. Andrews
*Attorney, Agent, or Firm*—Wenderoth, Lind & Ponack

[57] ABSTRACT

There is provided a process for producing a high-manganese iron alloy from a manganese ore and/or a pre-reduced product thereof in a top and bottom blown converter type reaction vessel holding molten iron or a molten manganese iron alloy, together with a molten slag, said molten iron or alloy and said molten slag being the products of a separate smelting furnace, gas being blown into said vessel through a bottom blowing nozzle, said process comprising charging said vessel with a supply of raw materials including at least one source of manganese and iron selected from a manganese ore containing manganese oxide and iron oxide and a pre-reduced product thereof, a solid carbonaceous substance and a slag forming agent, while simultaneously blowing gas selected from oxygen and a gas containing oxygen into said vessel through a top blowing lance to burn said carbonaceous substance so as to heat, melt and reduce said raw materials to form a melt containing manganese oxide and iron oxide; supplying an additional carbonaceous substance into said melt to reduce said manganese oxide and said iron oxide to form a molten high-manganese iron alloy and a molten slag, discontinuing said blowing of gas through said top blowing lance, and removing said molten high-manganese iron alloy and said molten slag from said vessel, said molten alloy being used for casting.

10 Claims, 14 Drawing Figures

Mn content in metal (%) : △—△ ;20%, ○—○ ;50%
Temperature : 1550°C
Flow rate of $O_2$ by top blowing : 2000 Nl/min.
Flow rate of $O_2$ by bottom blowing : 200 Nl/min.
Flow rate of Argon : 100 Nl/min.

Mn content in metal : 20%

PROCESS FOR PRODUCTION OF HIGH-MANGANESE IRON ALLOY BY SMELTING REDUCTION

BACKGROUND OF THE INVENTION

1. Field of the Invention

This invention relates to a process for the production of a high-manganese iron alloy such as ferromanganese. More particularly, this invention relates to a process which enables the high-manganese iron alloy heretofore obtained by using electric power as a heat source to be produced inexpensively, with manganese recovered in a high yield, by the smelting reduction of manganese oxide such as manganese ore with a solid carbonaceous substance such as coke used as a heat source and reducing agent. The term "high-manganese iron alloy" as used in this invention means an alloy formed preponderantly of Mn—Fe and used as a deoxidizer in steelmaking or as a manganese source in the manufacture of high-manganese steel. This alloy is required to contain not less than 20% by weight of manganese. Further, the high-manganese iron alloy products of the grades generally available in the market are classified by their carbon contents; the grades saturated with carbon and having carbon contents of about 7% are called high-carbon ferromanganese, the grades not saturated with carbon and having carbon contents roughly in the range of 1 to 2% are called medium-carbon ferromanganese, and the grades having carbon contents not exceeding 1% are called low-carbon ferromanganese. These three carbon-content classes are discriminated one from the others, depending on the purpose of steelmaking. Since phosphorus has an adverse effect on steelmaking, the phosphorus content of this alloy is desired to be as low as possible.

DESCRIPTION OF THE PRIOR ART

Heretofore, the high-manganese iron alloy such as, for example, ferromanganese containing not less than 60% of manganese by heating, melting, and reducing manganese ore and/or the pre-reduction product thereof in conjunction with a carbonaceous reducing agent such as coke and a slag forming agent in an electric furnace.

The electric power consumed in this method, however, amounts to about 2200 kWH per ton of high-carbon ferromanganese produced, for example, and it constitutes one major factor for the high cost of production in our country in which the price of electric power is high. It naturally follows that the energy efficiency of this method is notably low as viewed from the standpoint of primary energy. If a means is devised which permits the production of the high-manganese iron alloy to be effected by the use of a primary energy (specifically, the energy of combustion of a coal-type solid carbonaceous substance such as coal or coke) in the place of electric power, then the production will prove highly advantageous from the economic point of view.

Further, the production of the high-carbon ferromanganese by the use of an electric furnace has the disadvantage that the manganese content in the slag discharged from the electric furnace is generally so high as to fall in the range of 20 to 30% and, therefore, the production suffers from a low yield of manganese.

As a means for producing the high-carbon ferromanganese without the use of electric power, the method using a blast furnace has recently come to be held in high esteem again. According to this method, since the descending speed of molten mass and the reducing rate of manganese oxide are not easily coordinated and further since the heat generated when the CO gas produced by the reduction is converted by combustion into $CO_2$ is not utilized to advantage, the carbonaceous material as the heat source is required to be consumed in a large amount and, as the natural consequence, the CO gas occurs in a large amount. Thus, this method suffers from heavy loss of energy.

The carbon-unsaturated high-manganese iron alloy is generally produced through the following steps (a), (b) in an electric furnace.

(a) Manganese ore and silica stone as main raw materials are subjected to smelting reduction in the electric furnace with a carbonaceous material used as a reducing agent, to produce silicon-manganese which is composed of 60 to 70% of Mn, 14 to 23% of Si, 0.5 to 2% of C, and the balance to make up 100% of iron and inevitable impurities.

(b) In a separate electric smelting furnace, the aforementioned silicon-manganese, high-grade manganese ore, and lime are melted to oxidize Si in the aforementioned silicon-manganese into $SiO_2$ and, in consequence of this desiliconation, give rise to a medium- to low-carbon ferromanganese which is composed of 75 to 85% of Mn, 0.2 to 2% of Si, 0.5 to 2% of C, and the balance to make up 100% substantially exclusively of Fe.

In accordance with the conventional method which produces medium- to low-carbon ferromanganese by the desiliconation of silicon-manganese, since the electric energy consumed during the production of silicon-manganese in the step (a) amounts to 3500 to 5000 kWH per ton of the product and the electric energy consumed during the step (b) of desiliconation amounts to 800 to 1200 kWH per ton of the product, the cost of electric energy is high and the cost of the final product itself, particularly in Japan which is burdened with high price of electricity, becomes so high that it hardly meets international competition. This method, further, proves expensive in terms of equipment and work force because the step (b) necessitates exclusive provision of an electric furnace.

Instead of the silicon-manganese method described above, methods which produce medium- to low-carbon ferromanganese by blowing oxygen into molten high-carbon ferromanganese have been disclosed by Japanese Patent Publication No. SHO 55(1980)-4238 and Japanese Patent Publication No. SHO 57(1982)-27166. The method of the former patent publication effects the introduction of oxygen through a jacketed nozzle disposed in the lateral wall of a converter and the method of the latter patent publication introduces oxygen and natural gas through a nozzle of double-tube construction disposed on the bottom side of a converter. The specification of U.S. Pat. No. 3,305,352 and People's Republic of China Journal of Steel and Iron (Vol. 16, No. 5, May 1981) disclose methods which effect the blowing of oxygen into the converter interior through a top lance and Japanese Patent Application Laid-open No. SHO 54(1979)-97521 discloses a method for production which resorts to use of a bottom blowing converter.

Incidentally, manganese readily undergoes oxidation as compared with iron or chromium and the vapor of manganese has fairly high pressure. During the smelting by the forced introduction of oxygen, therefore, manganese is transformed into slag and the amount of manganese which is vaporized and suffered to escape from the system is large. The conventional methods, though capable of decarburization, do not provide economic smelting in terms of the yield of manganese. Thus, the methods which produce medium- to low-carbon ferromanganese by blowing oxygen downwardly, sideways, or upwardly into the converter interior have never been materialized on any commercial scale.

In the refinement of steel, the high-manganese iron alloy is used as a deoxidizer for molten steel for the purpose of improving the quality of steel and as an additive for supply of manganese. The phosphorus which is contained as an impurity in the high-manganese iron alloy is known to have an adverse effect upon the quality of the finally produced steel. The desirability of lowering the phosphorus content in the high-manganese iron alloy to the fullest possible extent has come to find growing recognition.

As regards the production of low-phosphorus high-manganese iron alloy, the following two methods have been heretofore accepted for actual operation on a commercial scale.

The first method produces a low-phosphorus high-manganese iron alloy by preparing a high-manganese iron alloy having a high silicon content (silicon-manganese with Si content 35%) in an electric furnace, divesting the alloy of slag, placing the alloy in a reactor provided with a stirring device (such as a stirrer or shaker), stirring the alloy in conjunction with a dephosphorizing agent (such as CaO, $CaC_2$, CaSi, or $CaF_2$) added downwardly thereto thereby dephosphorizing the alloy, and further subjecting the dephosphorized alloy to desiliconation as with manganese ore in an electric furnace. The second method comprises preparing a high-carbon high-manganese iron alloy in an electric furnace, divesting the alloy of slag, placing the alloy in a top blowing converter, blowing oxygen into the alloy thereby producing a carbon-unsaturated high-manganese iron alloy, divesting the new alloy of slag, placing the alloy in a reactor provided with a stirring device (such as a stirrer or shaker), and stirring the alloy in conjunction with a dephosphorizing agent (such as CaO, $CaC_2$, CaSi, or $CaF_2$) added downwardly thereto thereby dephosphorizing the alloy.

These methods, however, are complicate in that they entail as many as three steps necessitating alternate use of an electric furnace and other reactors as described above. Further, owing to the inevitable use of an electric furnace, these methods prove to be very expensive. The electric power consumed amounts to 4500 kWH per ton of product in the case of the first method and 2200 kWH per ton of product in the case of the second method. These high levels of electric power consumption are responsible for the high prices of their products.

SUMMARY OF THE INVENTION

If a process is developed for the so-called smelting reduction which permits the energy for reduction to be switched from the expensive electric power to a less expensive primary energy (especially the heat of combustion of a solid carbonaceous substance such as coal or coke) and operating conditions are found for amply lowering the manganese content in the slag to be formed during the course of the operation of this process, this process ought to prove very advantageous. For the development of the process of this nature, solution of the following problems constitutes a prerequisite.

(1) In the reduction of manganese, the allowable lower limit of the manganese oxide content in the molten slag is regulated by the relation of equilibrium. When the manganese content in the slag is lowered to a certain level, therefore, the reduction ceases to proceed any further. For the manganese content in the slag to be lowered and for the yield of manganese to be heightened, therefore, it becomes necessary to find conditions (such as of temperature and slag composition) which permit the ratio of (MnO)/[Mn] to be lowered. In the case of chromium and iron, unlike that the manganese, the ratio of (Cr)/[Cr] or that of (Fe)/[Fe] is notably low from the standpoint of equilibrium.

(2) Manganese itself exhibits a high vapor pressure at elevated temperatures. Thus, the loss of manganese due to vaporization during the course of production is large. The electric furnace process permits fair repression of the vaporization of manganese because the operation is continued under conditions such that the upper surface of the molten mass is kept covered with a fairly thick layer of the raw material yet to be melted. In the case of the smelting reduction method, unlike that of iron and chromium, how the vaporization of manganese is repressed is an outstanding problem.

(3) The conventional low-shaft type electric furnace has the merit of entailing virtually no consumption of the refractories lining the wall of the furnace because the high-temperature interior heated with the arc and the furnace wall are mutually insulated by the raw material intervening therebetween and also because the molten mass hardly flows near the furnace wall. In contrast, in the smelting reduction process, since the degree of concentration of heat is small, the load exerted to bear upon the refractories is increased when the raw material is stirred intensely and the overall temperature of the reaction zone is elevated to promote the reaction. Thus, there ensues the problem on how the refractories should be protected from injury due to the heavy load.

Because these problems remain yet to be solved, no practicable process has been developed besides the process which produces ferromanganese by the use of an electric furnace and the process which produces high-carbon ferromanganese by the use of a blast furnace. None of the research reports published to date suggest any approach to the comprehensive solution of these problems.

An object of the present invention is to solve the aforementioned problems and establish a commercially feasible process which effects the smelting reduction of manganese oxide such as manganese ore without the use of electric power.

To be specific, this invention aims to provide a process which enables a high-manganese iron alloy to be produced less expensively than the conventional process using expensive electric power as an energy for reduction by effecting the smelting reduction of manganese oxide such as manganese ore with a less expensive carbonaceous material and oxygen as the sources of heat thereby permitting the recovery of manganese to be attained at a higher yield than the conventional electric furnace process.

The aforementioned technical tasks imposed on the present invention are fulfilled by the present invention providing a process which effects the smelting reduction of manganese oxide such as manganese ore by using a top and bottom blowing converter containing a molten high-manganese iron alloy and molten slag in respectively fixed amounts, with the upper limit of the amount of the aforementioned molten high-manganese iron alloy fixed at 50% of the rated inner volume of the aforementioned converter and the amount of the aforementioned molten slag fixed at a level such that the jet of the top blow gas will avoid thrusting through the slag and coming into contact with the molten metal, introducing at least either manganese ore or the pre-reduction product thereof, a solid carbonaceous substance, and a slag forming agent into the aforementioned converter, feeding oxygen or an oxygen-containing gas into the interior of the converter, and subsequently heating, melting, and reducing the raw materials introduced as described above by combustion of the aforementioned solid carbonaceous substance thereby giving rise to a molten high-manganese iron alloy and molten slag. The desire to effect this process of smelting reduction more efficiently and enabling the recovery of manganese to be attained in a higher yield is accomplished by dividing the process into two periods, i.e. the first period of regular smelting reduction and the second period of finishing reduction, and keeping the temperature of the molten metal in the range of $1500°+\alpha°$ C. (where $\alpha \leqq 100°$ C.) during the course of the smelting reduction period in which the operation is carried out while continuing the supply of the raw materials including manganese oxide (ore), and switching the bottom blow gas to oxygen or a gas not containing oxygen and keeping the temperature of the molten metal in the range of $1500°\beta°$ C. (where $\beta \leqq 200°$ C. and $\alpha \leqq \beta$) during the course of the finishing reduction period in which the supply of the raw materials including manganese oxide is suspended.

Further in the aforementioned process for smelting reduction, after the formation of the carbon-saturated high-manganese iron alloy, carbon-unsaturated high-manganese iron alloy can be produced by removing part of the slag formed at the same time that the carbon-saturated high-manganese iron alloy is formed and then blowing oxygen or an oxygen-containing gas again into the molten metal thereby decarburizing the molten metal. Similarly after the formation of the carbon-unsaturated high-manganese iron alloy, a low-phosphorus high-manganese iron alloy can be produced by removing the slag in the whole amount thereof, adding to the molten metal a mixture of at least one substance selected from the group consisting of quick lime, calcium carbide, and calcium silicon with a halide of an alkaline earth metal, bottom blowing an inert gas into the molten metal thereby stirring the molten metal and dephosphorizing the molten metal. Optionally, a low-phosphorous high-manganese iron alloy can be produced by causing the carbon-saturated or unsaturated high-manganese iron alloy produced by the process described above to be stirred with a mixture of oxide or carbonate of barium with barium chloride added thereto.

The other functions and characteristic features of this invention will become apparent from the further disclosure of the invention to be given hereinbelow with reference to the accompanying drawings.

DETAILED DESCRIPTION OF PREFERRED EMBODIMENT

This invention relates to a process for effecting the smelting reduction of manganese oxide such as manganese ore for the production of a high-manganese iron alloy without the use of an electric furnace.

Generally when a manganese iron alloy is produced by smelting reduction, the following problems ensue as already described.

First, since the lower limit of the manganese oxide content in the molten slag is regulated by the relation of equilibrium, it is necessary to decrease the equilibrium ratio of (Mn)/[Mn] or the purpose of lowering the manganese content in the slag and improving the yield of manganese. Then, since manganese itself has high vapor pressure, it is necessary to repress the vaporization of manganese during the course of the operation for the purpose of minimizing the loss of manganese due to vaporization. Since the slag containing manganese oxide corrodes the refractories of the converter more heavily than the slag containing chromium or iron, the operation is required to be carried out under conditions such that corrosion of the refractories will be repressed.

With a view to attaining the object of this invention, the inventors first made a study on the process of the reduction of manganese oxide and then continued a detail study on the various problems enumerated above.

The manganese oxide and the iron oxide present in the molten slag which occurs in consequence of the melting of manganese ore are reduced by the excess carbon which is added to the furnace at the same time that the other raw materials are introduced. Typical reactions involved herein are represented by the following formulas.

$$MnO+C=Mn+CO \quad (1)$$
$$FeO+C=Fe+CO \quad (2)$$

Figure 2:
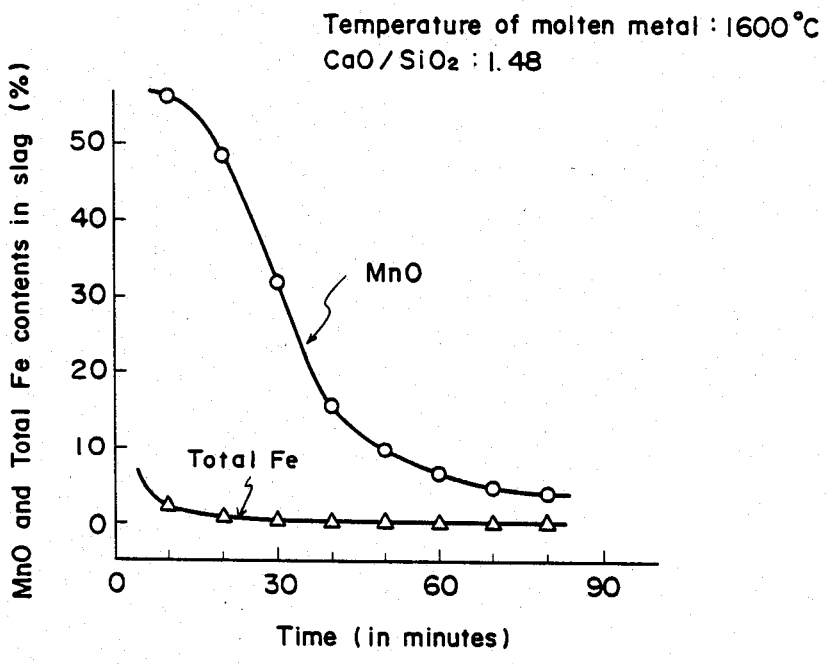
FIG. 2 is a diagram illustrating typical curves of the reduction occuring on manganese oxide and iron oxide after the melting of manganese ore.

FIG. 2 depicts a typical process of the reduction. The iron oxide in the slag is preferentially reduced. Thus, the iron content in the slag quickly falls and reaches the level of about 0.5% and thereafter remains unchanged. On examination, it has been demonstrated that this value of about 0.5% is ascribable mainly to the iron in the metal particles suspended within the slag. This means that iron is quickly reduced substantially in the whole amount thereof. In the meantime, the manganese oxide undergoes reduction in accordance with the formula of primary reaction rate indicated in the formula of (3) below and approaches equilibrium.

$$\text{Log}\frac{(MnO)_t-(MnO)_e}{(MnO)_{tO}-(MnO)_e}=k(t-t_O) \quad (3)$$

wherein $(MnO)_{tO}$ denotes the initial concentration of manganese oxide in the slag, $(MnO)_t$ denotes the concentration of manganese oxide in the slag at the age of t minutes of the reduction, $(MnO)_e$ denotes the equilibrated concentration of manganese oxide in the slag, and k denotes the reduction rate constant.

In the formula of (3), k is the constant indicating the reduction rate of manganese oxide and the value of k increases with the increasing rate of the reduction. This constant constitutes an important factor for decreasing the time required for the operation, improving the productivity of the operation, and preventing the loss of refractories by fusion.

Further in the formula of (3), $(MnO)_e$ is the value indicating the equilibrated concentration of manganese oxide in the slag. Under fixed conditions, this term $(MnO)_e$ always assumes a constant value. Thus, the manganese oxide content in the slag cannot be lowered below this level. This fact means that the formula of (1) represents an equilibrated reaction. In other words, the efforts to carry out the operation under conditions which enable this equilibrium to shift as much toward the righthand member (system of formation) of the formula of (1) as possible are an important prerequisite for lowering the manganese oxide content in the slag and improving the yield of manganese. It is well known that in the equilibrated reaction of this nature, the temperature and the concentration of the reaction system generally exert their effects to bear on the reaction. Further, the reduction of manganese oxide is affected by the basicity ($CaO/SiO_2$) of the slag.

Then, the effects produced by various factors on the reaction rate constant k and the equilibrated reaction were studied. The results are indicated below.

Figure 3:
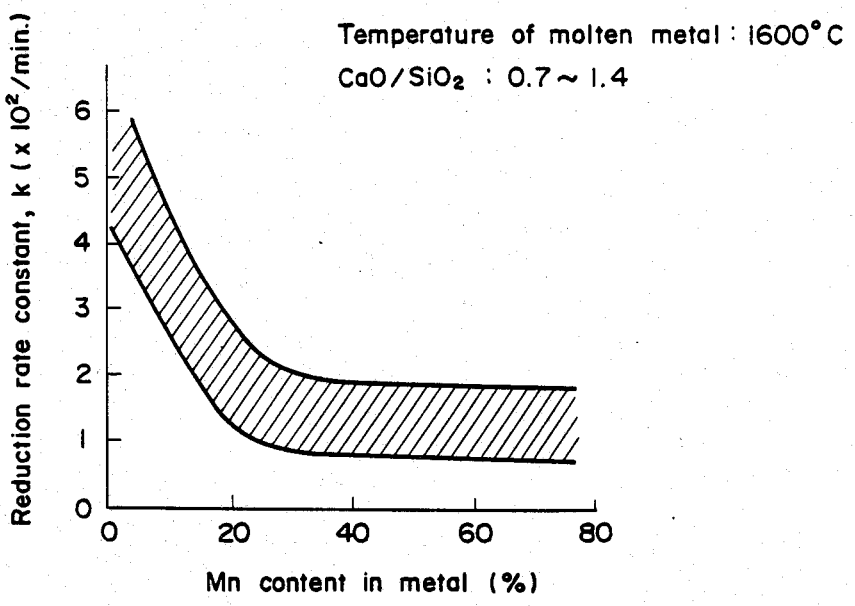
FIG. 3 is a diagram illustrating the relation between the manganese content in the metal and the reduction rate constant k of manganese oxide in the slag.

FIG. 3 shows the relation between the manganese content in the metal and the reduction rate constant k of manganese oxide in the slag determined at 1600° C. of molten metal temperature and at a varying basicity of slag in the range of 0.7 to 1.4. It is noted that the constant k is substantially constant where the manganese content in the metal exceeds about 30%. From this fact, it is clear that in the production of a manganese iron alloy having a manganese content of not less than 30%, the manganese content in the metal has substantially no bearing on the reduction rate of manganese oxide in the slag.

Figure 4:
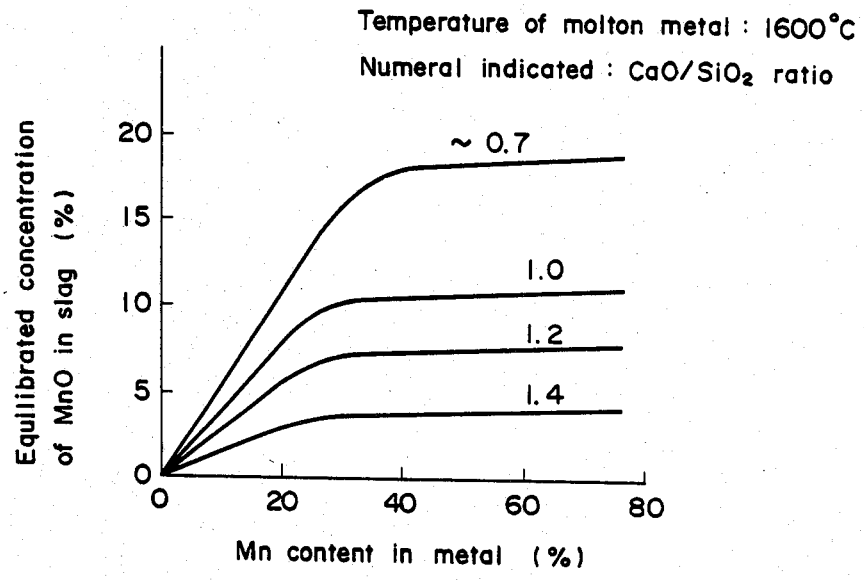
FIG. 4 is a diagram showing the relation of equilibrium between the manganese content in the metal and the manganese oxide content in the slag for varying basicity ($CaO/SiO_2$) of the slag.
Figure 5:
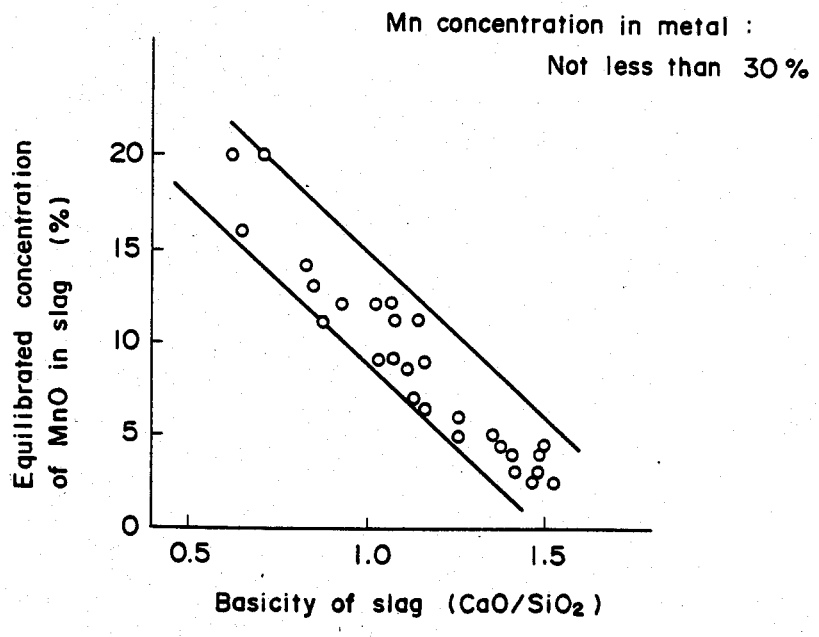
FIG. 5 is a diagram showing the relation between the bsicity of the slag and the equilibrated concentration of manganese oxide in the slag.

The data obtained of the relation of equilibrium between manganese oxide in the slag and manganese in the metal are graphically represented in FIG. 4 and FIG. 5. It is noted from FIG. 4 that so long as the manganese content in the metal increases up to about 20%, the manganese oxide in the slag increases substantially proportionately to the manganese content in the metal but that when the manganese content in the metal increases past the level of about 30%, the effect of the manganese content in the metal on the manganese content in the slag is very small. From FIG. 5, it is noted that the basicity of the slag heavily affects the manganese oxide content in the slag.

Figure 6:
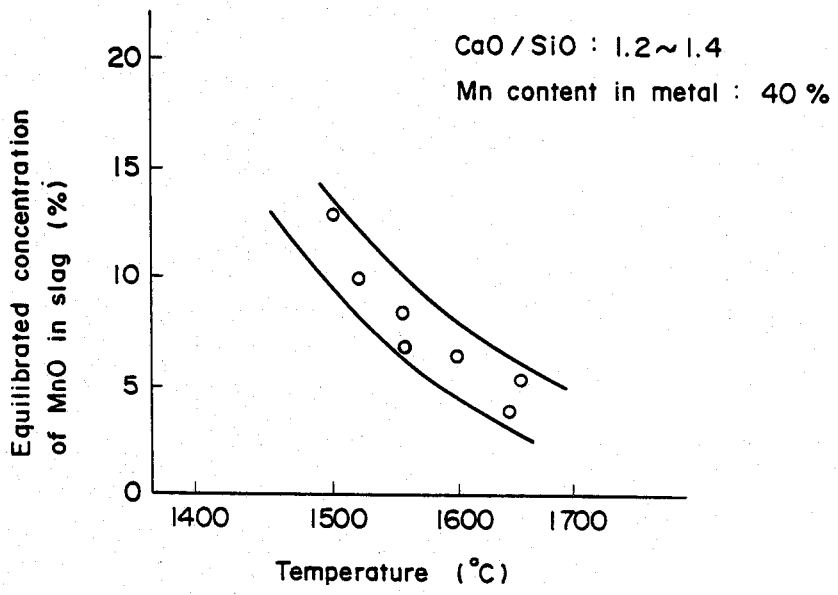
FIG. 6 is a diagram showing the effect of temperature on the equilibrated concentration of manganese oxide in the slag.

FIG. 6 is a diagram showing the effect of the temperature of the molten metal upon the equilibrated concentration of manganese oxide in the slag. It is noted from the data that the equilibrated concentration of manganese oxide decreases with the increasing temperature of the molten metal.

Figure 7:
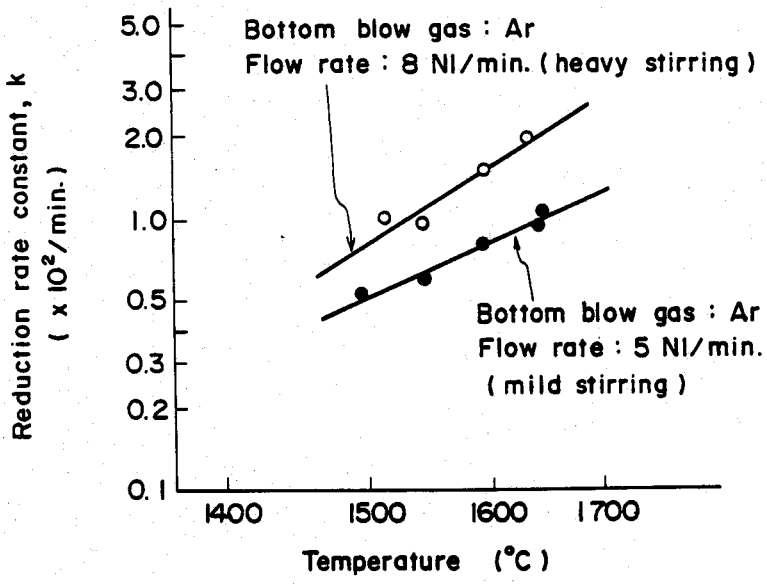
FIG. 7 is a diagram showing the effect of temperature on the reduction rate constant of manganese oxide in the slag.

FIG. 7 shows the effect of the temperature of the molten metal on the reduction rate constant k. From the data given therein, it is noted that the constant k increased with the increasing temperature of the molten metal. The reaction rate is increased by adding to the force used in stirring the molten metal and the molten slag by the bottom blowing of gas. The stirring by the bottom blowing of gas is desired to be as forceful as permissible. If the force of the stirring exceeds a proper level, however, the jet of the bottom blow gas is suffered to thrust through the layer of molten slag covering the molten metal possibly to the extent of adversely affecting the condition of stirring. It is important, therefore, that the amount of the bottom blow gas used for the stirring should be kept from exceeding the proper level mentioned above.

As the result of the studies described above, it has been ascertained to the inventors that in the production of high-manganese iron alloy by the smelting reduction, it is advantageous to increase the basicity of the slag and heighten the temperature of the molten metal without reference to the manganese content in the metal for the purpose of increasing the reduction rate and lowering the manganese oxide content in the slag. If the basicity of the slag is excessively high, the melting point of the slag itself rises so much as to render the operation difficult. Thus, the optimum $CaO/SiO_2$ ratio falls in the range of 1.4 to 1.6. If the temperature of the molten metal is excessively high, the loss of manganese by vaporization and the loss of refractories by fusion are aggravated.

Figure 8:
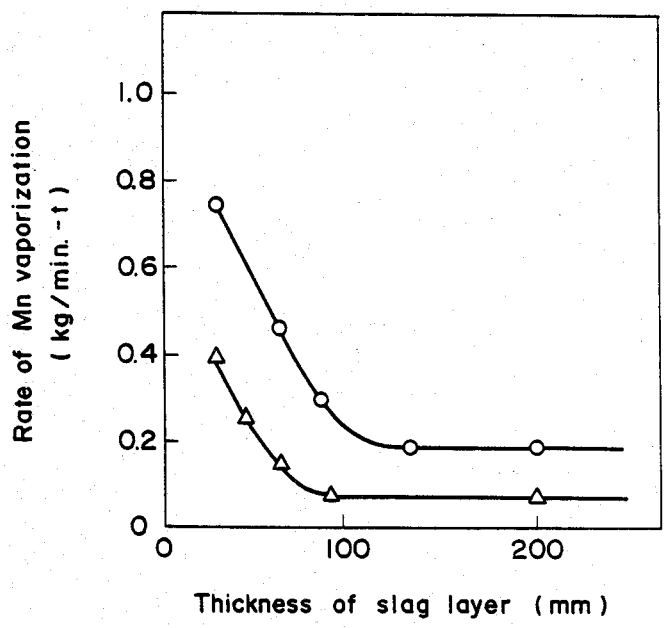
FIG. 8 is a diagram showing the relation between the rate of vaporization of manganese and the thickness of the layer of molten slag.

The relation between the rate of the vaporization of manganese and the thickness of the molten slag formed to cover the molten metal is illustrated in FIG. 8. It is noted from the data given therein that where the flow rate of $O_2$ introduced by top blowing is 2000 N.liter/-min., for example, the rate of the vaporization of manganese increase when the thickness of the layer of the molten slag is not more than about 90 mm. This increase in the rate of the vaporization of manganese may be logically explained on the supposition that when the layer of the molten slag is thin, the jet of the top blow gas forces its way through the layer of the molten slag covering the surface of the molten metal, the oxygen in the top blow gas comes into contact with the molten metal and, at the point of contact, oxidizes the manganese and the carbon in the molten metal, and the portion of the molten metal overheated with the heat of the oxidation promotes the vaporization of manganese. For the purpose of continuing the operation while repressing the vaporization of manganese, it is necessary to give to the layer of the molten slag a thickness enough to prevent the jet of the top blow gas from thrusting through the layer of the molten slag and coming into contact with the molten metal. The thickness of the molten slag, $D_{op}$ (mm), necessary for this purpose is expressed, in the form of a function of the flow rate of the top blow gas ($O_2$), $F_{t-O2}$ ($Nm^3$/hr), by the following formula (3)'.

$$D_{op}=18F_{t-O2}^{\frac{1}{3}} \quad (3)'$$

In the actual operation, the amount of slag increases as the introduction of the raw material proceeds. The problem concerning the thickness of the slag described above, therefore, should be given special attention during the initial stage of the whole course of smelting reduction and during the stage immediately following the removal of slag from the furnace in each batch.

Figure 9:
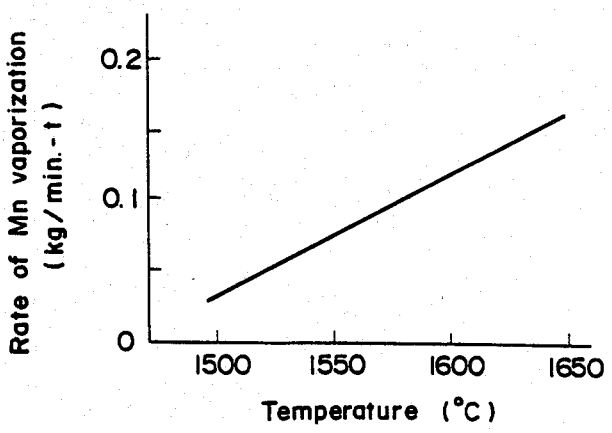
FIG. 9 is a diagram showing the effect of temperature on the rate of vaporization of manganese.
Figure 10:
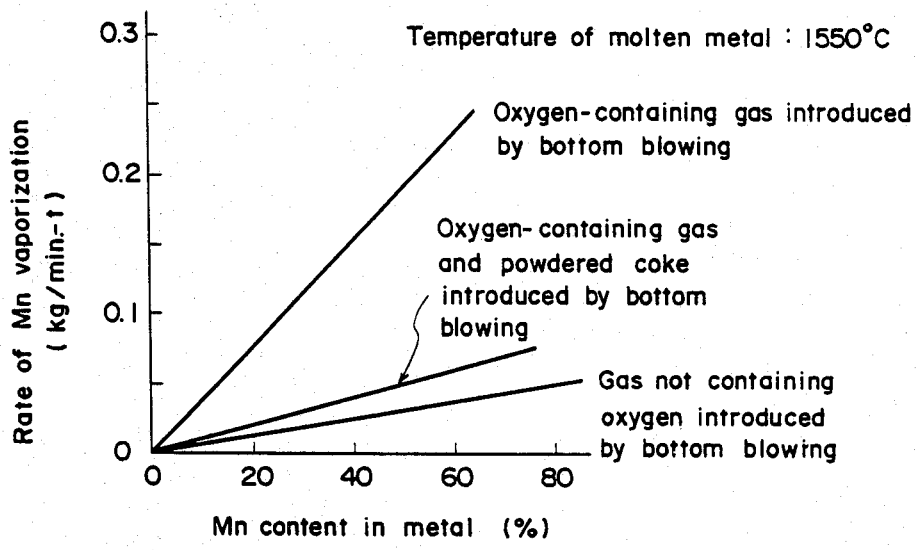
FIG. 10 is a diagram showing the effects of the manganese content in the metal and the kind of bottom blow gas on the rate of vaporization of manganese.

The relations respectively of the temperature of the molten metal and the manganese content in the molten metal to the loss of manganese due to vaporization are shown in FIG. 9 and FIG. 10. It is clear from FIG. 9 that the amount of manganese vaporized increases in proportion as the temperature of the molten metal increases. This relation contradicts the aforementioned effects of temperature on the reaction rate and the equilibrium. The optimum conditions, therefore, should be determined in due consideration of these contradicting effects.

The data of FIG. 10 indicate that the amount of manganese vaporized increases in proportion as the manganese content in the molten metal increases.

The repression of the loss of manganese due to vaporization is attained effectively by forming the bottom blowing nozzle in a triple tube construction and bottom blowing powered coal or powdered coke in conjunction with a carrier gas through the inner tube of the nozzle. The effect of repression so obtained is illustrated in FIG. 10. The data are logically explained on the supposition that when the molten manganese iron alloy is formed within the converter, the manganese and the carbon in the molten alloy near the bottom blowing nozzle are partially oxidized with the bottom blow oxygen and that although the evolution of heat by this oxidation may at times induce the vaporization of manganese from the zone superheated by the aforementioned heat, the powdered coal or the powdered coke blown through the triple tube bottom blowing nozzle go to lower the temperature of the superheated zone and, as the result, the otherwise possible vaporization of manganese from the superheated zone is repressed.

When a gas containing no oxygen is used exclusively for the bottom blowing, the repression of the vaporization of manganese is attained more effectively. This situation is evident from the data of FIG. 10. The use of this gas precludes the occurrence of the superheated zone owing to aforementioned the mechanism involving the oxygen in the bottom blow gas and, as the result, completely eliminates the loss of manganese due to the evaporation causable by the bottom blow gas.

Figure 11:
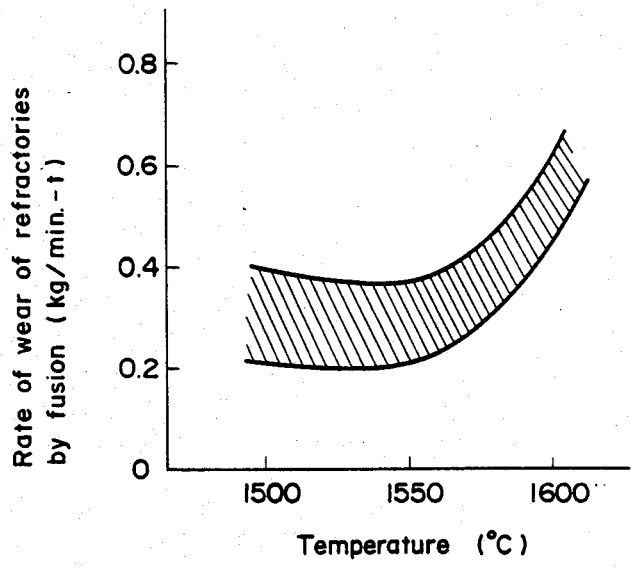
FIG. 11 is a diagram showing the relation between the rate of wear of refractories by fusion and the temperature.

Magnesia-dolomite refractory bricks are used in lining the converter. The effect of temperature on the rate of wear of the refractories due to fusion is shown in FIG. 11. It is noted from the data given therein that the rate of the wear of refractories due to fusion increases with the rising temperature beyond the level of about 1550° C. The rate of wear of refractories by fusion bears on the number of batches of operation performed in the converter and constitutes an important factor affecting the productivity of the process in its actual operation. In this respect, it may be proper to fix the operating temperature of the converter in most cases somewhere below the level of 1550° C.

Figure 12:
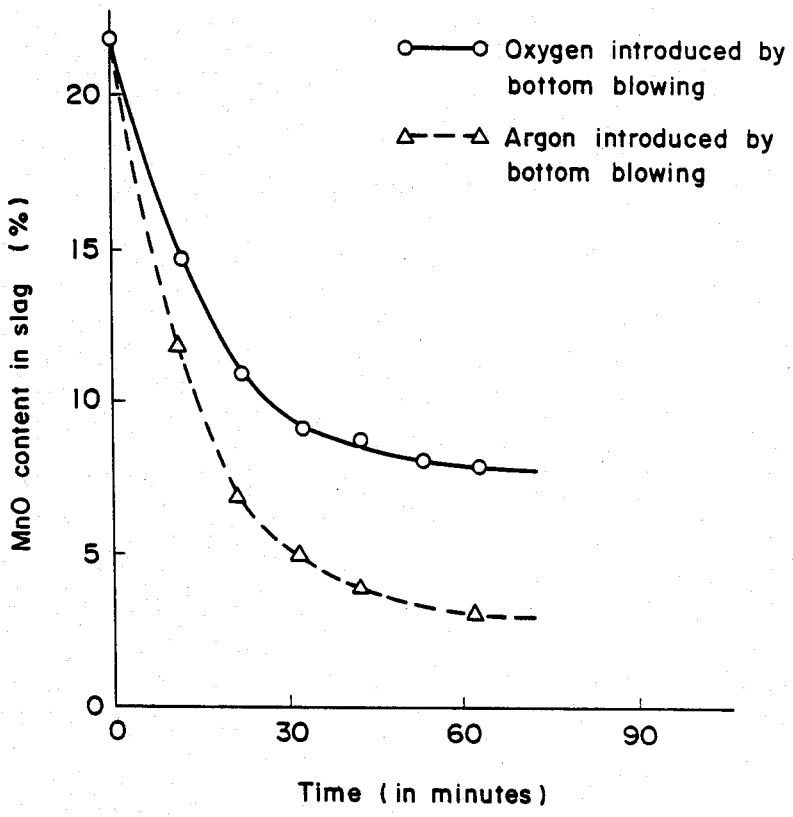
FIG. 12 is a diagram showing the effect of the kind of bottom blow gas upon the rate of the reduction of manganese oxide and the equilibrated concentration of manganese oxide in the slag.

The bottom blowing of the gas not containing oxygen is effective in lowering the manganese oxide content (equilibrated concentration) in the slag. FIG. 12 compares the results of the bottom blowing of an ordinary oxygen-containing gas with those of the bottom blowing of argon gas used exclusively. It is clear from the data of FIG. 12 that the reduction of manganese oxide in the slag proceeds more quickly and the final concentration of manganese oxide is lower when argon gas alone is bottom blown. This clear difference is logically explained on the supposition that when oxygen is bottom blown, the manganese in the molten meal is oxidized and this oxidation is offset by part of the reduction of the manganese oxide in the slag and, as the result, the reduction as a whole is proportionately retarded and the manganese oxide content in the slag is increased and that when the bottom blow gas contains no oxygen, the manganese in the molten metal is not oxidized and, as the result, the reduction of manganese oxide alone is allowed to proceed.

Based on the results of studies described above, the optimum operating procedure has been established for the production of a high-manganese iron alloy by the use of a top and bottom blowing converter. The knowledge so acquired has led to perfection of the present invention.

Now, the present invention will be described in detail below.

Figure 1:
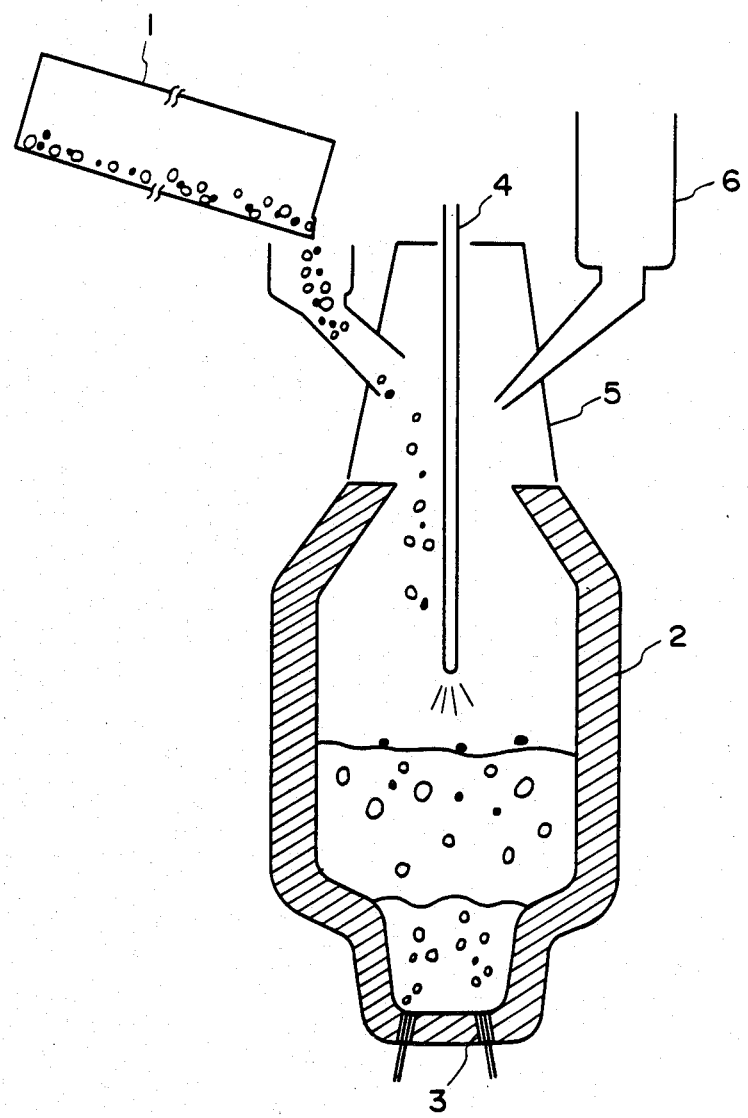
FIG. 1 is a longitudinal section illustrating a typical apparatus to be used in working the present invention.

A typical apparatus to be used in working the present invention is shown schematically in FIG. 1. A top and bottom blowing converter 2 is desired to be a converter of the type capable of top and bottom blowing of gas. This converter is provided in the bottom thereof with one or more nozzles 3. The number of such nozzles is to be determined by the capacity of the converter and the amount of gas to be blown into the converter. The nozzle 3 is formed in a double tube construction or triple tube construction. The nozzle of the double tube construction is desired to be adapted so that the inner tube is used for transferring oxygen or an oxygen-containing gas, some hydrocarbon gas such as propane, an inert gas such as $N_2$, or Ar, $CO_2$ or steam and the outer tube for transferring a cooling gas which is some hydrocarbon gas such as propane, an inert gas such as $N_2$ or Ar, $CO_2$ or steam. The nozzle of the triple tube construction is desired to be adapted so that the inner tube is used for transferring a gas containing powdered coal or powdered coke, the medium tube for transferring oxygen or an oxygen-containing gas, some hydrocarbon gas such as propane, an inert gas such as $N_2$ or Ar, $CO_2$ or steam, and the outer tube for transferring the aforementioned cooling gas. In FIG. 1, 4 denotes a lance used for top blowing of gas. The apparatus to be used in the present invention is basically composed of the converter 2, the bottom blowing nozzle 3, and the top blowing lance 4.

As the raw material, the manganese ore can be in the form of dry raw ore. Otherwise, the manganese ore may be pre-reduced or sintered in a rotary kiln, a fluidized reducing furnace, or a sintering machine. The three forms of manganese ore described above may be used either singly or in the form of a mixture of at least two members.

The solid carbonaceous substance can be a coal type solid carbonaceous substance such as coal or coke. Lime or lime stone is chiefly used as the slag forming agent. All the raw materials used herein are desired to be in dry state.

At the time that the raw materials are introduced into the aforementioned top and bottom blowing converter, when any of the raw materials has undergone a pretreatment, the raw material freshly discharged from the pretreating device is introduced directly into the aforementioned converter before it has time to cool off. This practice proves effective in economizing the total energy consumption because the latent heat of this raw material can be fully utilized. When manganese ore is pre-reduced in a rotary kiln, for example, the manganese ore and a carbonaceous substance are placed in the aforementioned kiln and thermally reduced at a temperature of about 1000° C. By directly connecting the aforementioned kiln to the top and bottom blowing converter, therefore, the raw materials heated to about 1000° C. can be directly introduced into the converter. A typical arrangement for effecting this direct transfer is illustrated in FIG. 1. In FIG. 1, 1 denotes a rotary kiln and 6 denotes a device for feeding secondary raw materials such as a slag forming agent.

Now, the manner in which the present invention is worked will be described in detail below.

A converter capable of top and bottom blowing of gas is charged with manganese ore and/or the prereduction product thereof, a solid carbonaceous substance, and a slag forming agent and it is also supplied with oxygen or an oxygen-containing gas to effect reduction of the manganese oxide. In this process for the production of high-manganese iron alloy by smelting reduction, the basic operating pattern is adopted in which the following flow of steps constitutes one cycle. Optionally, the period of finishing reduction may be followed by a treatment for decarburization and a treatment for dephosphorization.

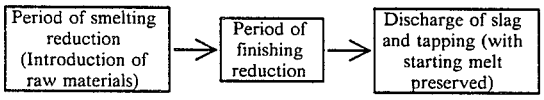

The period of smelting reduction represents a step wherein manganese oxide as the main raw material is introduced into the converter already containing therein prescribed amounts of a molten high-manganese iron alloy and molten slag and, at the same time, oxygen or an oxygen-containing gas is supplied thereto so as to effect smelting reduction of the manganese oxide thermally.

The molten high-manganese iron alloy is intended to be used as the starting melt for the purpose of maintaining the interior of the converter stable near the bottom blowing tuyere. The amount of this molten alloy, therefore, is desired to be as small as possible on condition that it suffices for the purpose just mentioned. Although this amount is variable with the inner volume of the converter, is is generally sufficient so long as it accounts for about 30% of the rated capacity of the converter. It is not allowed to exceed 50% at most.

The molten slag contained in advance in the converter is necessary for the purpose of preventing loss of manganese due to vaporization. The amount of the molten slag, therefore, is required to be such that the layer of the molten slag formed to cover the molten metal will prevent the jet of the top blow gas from thrusting through the layer of molten slag and coming into contact with the underlying molten metal. The thickness of the layer, though variable with the scale of operation, is not less than about 170 mm in the case of the scale indicated by way of illustration in FIG. 8. This thickness is also required to be enough to prevent the metal splash caused during the stirring of the molten metal by the bottom blowing of gas from flying through the layer of the molten slag. This thickness is about 100 mm. It may be smaller than the thickness required in the case of the aforementioned top blowing of gas. Thus, the thickness of the layer of molten slag can be determined exclusively in due consideration of the effect of the top blowing of gas.

When the converter is recurrently used in successive batches of operation, the molten metal and the molten slag required to be contained therein at the start of a given batch of operation may be preserved portions of the molten metal and the molten slag formed during the immediately preceding batch of operation. For use in the first batch of operation, the molten metal is not specifically limited to a molten high-manganese iron alloy. For example, molten pig iron may be used instead.

In the converter which already contains therein the aforementioned amounts of molten metal and molten slag, the bottom blow gas is required to have been introduced in advance. When the bottom blowing nozzle is in a double tube construction, at least one member selected from the group consisting of oxygen, oxygen-containing gas, hydrocarbon gases such as propane, an inert gas such as $N_2$ or Ar, and $CO_2$ or steam is blown in through the inner tube and at least one member selected from the group consisting of hydrocarbon gases such as propane, an inert gas such as $N_2$ or Ar, and $CO_2$ or steam is blown in through the outer tube. When the bottom blowing nozzle is in a triple tube construction, powdered coal or powdered coke and/or powered lime is blown in through the inner tube in conjunction with a carrier gas, one member selected from the group consisting of oxygen, oxygen-containing gas, hydrocarbon gases such as propane, an inert gas such as $N_2$ or Ar, and $CO_2$ or steam is blown in through the medium tube, and at least one member selected from the group consisting of hydrocarbon gases such as propane, an inert gas such as $N_2$ or Ar, and $CO_2$ or steam is blown in through the outer tube. As the carrier gas mentioned above, any gas used through the outer tube or part of the gas produced during the course of the process can be used.

When the converter is prepared as described above, the solid carbonaceous substance is placed in the converter and the introduction of oxygen or an oxygen-containing gas through the top blowing lance is started to set the aforementioned solid carbonaceous substance burning. When oxygen or an oxygen-containing gas is used as the bottom blow gas, the ratio of the amount of oxygen for top blowing to that of oxygen for bottom blowing is desired to fall in the range of 97:3 to 80:20.

Then, the manganese ore and/or the pre-reduction product thereof, the solid carbonaceous substance, and the slag forming agent are introduced into the aforementioned converter. In this case, the raw materials mentioned above may be introduced collectively in the form of a mixture or separately of one another. The slag forming agent is used in an amount such that the molten slag consequently formed will have a proper composition. To be specific, the optimum amount of the slag forming agent is such that the basicity of the molten slag will finally fall in the range of 1.4 to 1.6.

During the period of smelting reduction, the aforementioned raw materials are introduced continuously or intermittently into the converter so as to heat and melt the raw material by the combustion of the carbonaceous substance with oxygen. In that case, the amounts of raw materials to be introduced, the height of the top blowing lance, and the amount of the top blow gas are adjusted so that the temperature of the molten metal within the converter will be kept in the range of $1500°+\alpha°$ C. (where $\alpha \leqq 100°$ C.). If the temperature of the molten metal is not more than 1500° C., the viscosity of the molten metal is higher than is desired and the reduction rate is slower than is required (FIG. 7). If this temperature exceeds 1600° C., the refractories are heavily corroded as noted from the data of FIG. 11 and the loss of manganese in the molten metal due to vaporization is increased as noted from the data of FIG. 9. During the period of smelting reduction, therefore, it is appropriate to keep the temperature of the molten metal in the range of $1500°+\alpha°$ C. (where $\alpha \leqq 100°$ C.). Preferably, this temperature is desired to be kept in the neighborhood of 1550° C. during the period of smelting reduction.

As described already, during the period of smelting reduction, the introduction of powdered coal or powered coke through the bottom blowing nozzle of the triple tube construction is highly effective in repressing the loss of manganese due to vaporization (FIG. 10).

After the prescribed amounts of raw materials have been introduced into the converter and thoroughly melted as described above, the operation of the converter enters the period of finishing reduction.

The period of finishing reduction represents a step in which the manganese oxide persisting in the molten raw materials is reduced to the fullest possible extent with excess carbon.

As the period of finishing reduction begins, the introduction of raw materials is discontinued and, where the bottom blow gas is oxygen or an oxygen-containing gas, this gas is switched to a gas not containing oxygen such as, for example, one member selected from the group consisting of hydrocarbon gases such as propane, an inert gas such as $N_2$ or Ar, and $CO_2$ or steam. Since manganese is more susceptible to oxidation then iron and chromium and the heat of this oxidation is liable to give rise to a superheated zone in the molten metal, this switch of the bottom blow gas is necessary for the purpose of precluding the loss of manganese due to the vaporization causable in the superheated zone. This measure for the prevention of the loss of manganese due to vaporization is effective as shown in FIG. 10.

The discontinuation of the introduction of raw materials results in a rise of the temperature of the molten metal within the converter. As shown by the data of FIG. 6 and FIG. 7, the equilibrated concentration of manganese oxide in the slag decreases and the reduction rate increases in proportion as the temperature of the molten metal increases. It is, therefore, desirable to keep the temperature of the molten metal at a higher level during the period of finishing reduction than during the period of smelting reduction and bring the reduction to completion as soon as possible. It is nevertheless evident that the loss of manganese due to vaporization and the wear of refractories of fusion are aggravated in proportion as the temperature of the molten metal is increased. In consideration of this fact, it is safely concluded that the temperature of the molten metal during the period of finishing reduction should be kept in the range of $1500°+\beta°$ C. ($\beta \leqq 200°$ C.), preferably in the range of 1600° C. to 1650° C. This control of the temperature in the range mentioned above is attained by adjusting the rate of oxygen blowing.

As the reaction is continued for a prescribed length of time, the manganese oxide in the molten raw materials is reduced with excess carbon to give birth to a molten high-manganese iron alloy and molten slag.

The high-manganese iron alloy formed by this time is saturated with carbon substantially completely and, therefore, contains carbon in an amount of about 7%. The manganese oxide content in the slag falls in the range of about 5 to 10%. Where the operation is aimed at a high-carbon high-manganese iron alloy, the molten metal and the molten slag are withdrawn from the converter at this stage and the molten metal is cast by the conventional method. Part of the molten metal and the molten slag so formed is left behind in the converter to be used as starting melt in the subsequent batch of operation.

Now, the present invention embodied in the production of a carbon-unsaturated high-manganese iron alloy will be described.

After a molten carbon-saturated high-manganese iron alloy and molten slag have been formed by the operation described above, part of the molten slag is removed from the converter. To the remaining molten slag and the molten carbon-saturated high-manganese iron alloy held within the converter, oxygen or an oxygen-containing gas is introduced chiefly by bottom blowing to effect decarburization of the molten metal.

During the initial stage of oxygen blowing in this step, the manganese in the molten metal undergoes oxidation, the temperature of the molten metal rises sharply, and subsequently the oxidation of carbon begins. Consequently, the temperature of the molten metal continues to rise. At this stage, the temperature of the molten metal is controlled in the range of 1650° to 1850° C. so as to repress the carbon content of the final product. For the carbon content in the final product to be repressed below 2%, the final temperature of the molten metal is controlled within the range of 1750° to 1780° C. For the carbon content to be repressed below 1%, the final temperature is controlled within the range of 1820° to 1850° C.

If the temperature of the molten metal is lower than 1650° C., the oxidation of manganese proceeds preferentially over that of carbon. If the temperature is higher than 1850° C., the vaporization of manganese is intensified and the consequent loss of manganese is aggravated. Thus, the temperature of the molten metal during the reduction is desired to be kept within the range of 1650° to 1850° C. This control of the temperature of the molten metal can be effected by adjusting the amount of oxygen to be admitted into the molten metal besides adding a cooling material such as high-, medium-, or low-carbon ferromanganese or flux to the molten metal.

As the carbon content in the molten metal is lowered to a prescribed level, the manganese oxidized into manganese oxide is contained in the formed slag in a concentration of 30 to 50% as manganese. The slag containing the manganese oxide as described above can be used as part of the raw materials for the production of a high-carbon ferromanganese.

The metal consequently formed in the converter is withdrawn from the converter as a finished product.

Now, the procedure of treatment required for the production of a low-phosphorus high-manganese iron alloy will be described below.

The phosphorus content in the high-manganese alloy depends heavily on the phosphorus content in the manganese ore as the principal raw material. The desire to lower the phosphorus content in the produced high-manganese iron alloy is met by the practice of subjecting the alloy produced as described above to dephosphorization by any of the following methods.

(i) Reductive dephosphorization

It is held that the dephosphorization of a molten high-manganese iron alloy with a calcium compound such as, for example, calcium carbide proceeds as shown by the following formula.

$$3CaC_2 + 14Mn \longrightarrow 3[Ca] + 2Mn_7C_3 \quad (4)$$

$$3[Ca] + 2P \longrightarrow Ca_3P_2 \quad (5)$$

In the formula of (4), $Mn_7C_3$ indicates the occurrence of saturation with carbon. In the case of a carbon-saturated high-manganese iron alloy, the reaction of the formula of (4) does not occur and, therefore, that of the formula of (5) naturally does not ensue. The method which lowers the phosphorus content of a molten high-manganese iron alloy by conferring upon the molten alloy a state unsaturated with carbon and inducing the molten alloy to undergo the reaction of the formula of (4) thereby causing phosphorus to pass into the molten flux, therefore, proves to be effective.

Figure 13:
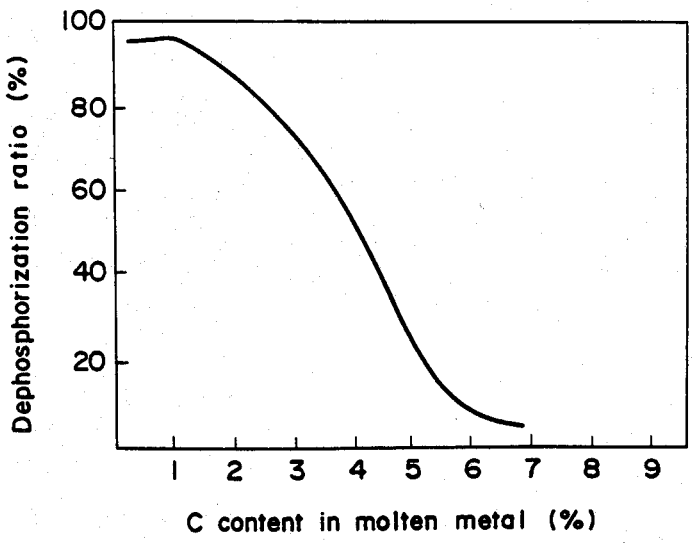
FIG. 13 is a diagram showing the effect of the carbon content in the molten metal upon the dephosphorization ratio during the course of the dephosphorizing treatment.

The inventors performed experiments on high-manganese iron alloys to determine the relation between the carbon content and the dephosphorization ratio. As the result, it has been ascertained to them that, as shown in FIG. 13, sufficient dephosphorization is obtainable when the carbon content is not more than 4%.

From the results of the experiments, it is found that a low-phosphorus high-manganese iron alloy is produced by forming a molten carbon-unsaturated high-manganese iron alloy in accordance with the aforementioned process, removing substantially wholly the slag formed at the same time, adding to the remaining molten carbon-unsaturated high-manganese iron alloy a proper amount of a dephosphorizing flux, and bottom blowing an inert gas thereby stirring the molten metal forcibly.

As the dephosphorizing flux, a mixture of at least one member selected from the group consisting of quick lime, calcium carbide, and calcium silicon with a halide of an alkaline earth metal. Quick lime, calcium carbide, or calcium silicon reacts with the high-manganese iron alloy readily to form elemental calcium and the calcium in the nascent state so formed easily combines itself with phosphorus to form $Ca_3P_2$.

For the purpose of enabling $Ca_3P_2$ formed in the reaction of the formula of (5) to be dissolved in the flux and retained stably therein, the flux is required to incorporate therein the aforementioned halide of an alkaline earth metal. Thus, the aforementioned halide is required to be contained in a concentration of not less than 5% in the flux. The components of the mixture, therefore, are combined in amounts such that the halide concentration in the mixture will exceed the lower limit just mentioned. This halide may be a chloride. Since the chloride is hygroscopic, it is most advantageous to use fluorite ($CaF_2$) as the halide.

It suffices to add this flux to the molten metal in an amount enough for effecting required dephosphorization. In the case of a high-manganese alloy, if the molten metal is exposed through the surface of the molten slat, the loss of manganese in the molten metal due to vaporization is aggravated. The addition of the flux yields satisfactory results when the flux is used in an amount to give the layer of molten slag a thickness enough to prevent the metal splash causable during the stirring of the molten metal with the bottom blow gas from thrusting through the layer of molten slag.

Further, since this slag is required to be capable of dephosphorizing the molten metal, it is necessary that the slag used in the first step should be discharged in the whole amount thereof and the dephosphorizing flux should be added anew. This dephosphorizing flux is used in the form of solid granules or particles. On contact with the molten carbon-unsaturated high-manganese iron alloy, the flux is melted by the heat of the molten metal and allowed to induce a dephosphorizing reaction. In this case, the molten metal and the added flux are required to be effectively stirred for the purpose of shortening the time of operation. The forced stirring by the bottom blowing as adopted by the present invention can be completed within $\frac{1}{2}$ to $\frac{2}{3}$ of the time required by the conventional method using a mechanical stirring or shaker. This decrease of the time required for the stirring brings about the effect of lowering the aforementioned loss of manganese due to vaporization.

The forced stirring by the bottom blowing of gas, coupled with the bottom blowing of part of the flux in a powdered form as mixed with the bottom blow gas into the molten metal, turns out to be an advantageous measure effective in shortening the time required for the stirring and improving the dephosphorization ratio.

As concerns the temperature of the molten metal in this step, this temperature is required to fall in the range of 1300° to 2200° C. for the purpose of allowing the reactions of the formulas of (4), (5) among other dephosphorization reaction formulas described above to proceed smoothly. This is because the reaction of the formula of (4) does not proceed when the temperature deviates from the range just mentioned. It is nevertheless desirable to carry out the treatment of dephosphorization at as low a temperature as permissible for the purpose of decreasing the loss of manganese by vaporization and alleviating the damage done by the dephosphorizing flux on the lining material of the converter. If the temperature is excessively low, the viscosity of the molten metal increases and the stirring of the molten metal cannot be carried out smoothly. Thus, the optimum temperature of the molten metal at this stage falls in the range of 1400° to 1500° C.

In the step of the foregoing description, the top and bottom blowing converter which was used first for the production of high carbon high-manganese iron alloy can be used in its unaltered form. It is, of course, permissible for the step of the production of the high-carbon alloy, the step of decarburization, and the step of dephosphorization to be carried out in different converters.

(ii) Oxidative dephosphorization

It has been ascertained to the inventors that a molten high-manganese iron alloy produced by the aforementioned smelting reduction and possessed of a carbon content equalizing or exceeding the level of saturation (0.3%) can be dephosphorized when the molten metal and a proper amount of a flux, i.e. a mixture of barium oxide or carbonate with barium chloride, added thereto are stirred.

In this case, the barium oxide or carbonate functions as a flux of higher basicity than CaO and lowers the activity coefficient of $P_2O_5$. In the meantime, the barium chloride lowers the melting point and viscosity of the slag and gives rise to physical conditions beneficial to the progress of dephosphorization. Further, when the carbonate is used, the $CO_2$ produced by the decomposition of this carbonate is used for oxidizing the phosphorus in the manganese iron alloy as shown by the following formula.

$$2[P]+5CO_2 \rightarrow (P_2O_5)+5CO$$

Thus, the phosphorus so oxidized is seized in the form of $P_2O_5$ within the slag.

When the barium oxide is used, since this compound lacks an oxidizing power, it is required to be used in combination with an oxidizing agent for phosphorus, i.e. at least one member selected from the group consisting of oxidizing gases such as $O_2$ and $CO_2$, oxides of iron and manganese, and carbonates of alkali metals and alkaline earth metals such as $Li_2CO_3$ and $CaCO_3$.

The flux to be used is in the form of solid granules or particles. It can be added by being superposed on the molten metal and/or being injected into the molten metal. For the purpose of decreasing the time of stirring and improving the efficiency of dephosphorization, this addition is made most effectively by injecting the flux in the form of granules.

As to the manner of stirring, the stirring by gas blowing is effective in decreasing the time of stirring as compared with the conventional method using a mechanical stirrer or shaker and it can be carried out in the same converter that is used for the production of a high-carbon high-manganese iron alloy. Optionally, the molten high-manganese iron alloy produced in the first converter may be transferred into another converter and subjected therein to dephosphorization by a different method of stirring (such as, for example, the stirring with a mechanical stirrer or shaker). When the stirring is effected by gas blowing, the gas to be used for the blowing may be an oxidative gas or an inert gas. Concrete examples of the gas used advantageously therefor include Ar, $N_2$, and $CO_2$.

As concerns the working temperature in the present step, it is desired to be as low as permissible because the distribution ratio of $(P_2O_5)/[P]$ which is determined by the equilibrium of the reaction of $2P+\frac{1}{2}O_2 \rightleftarrows P_2O_5$ increases with the decreasing working temperature. The fact that the liquids temperature between the molten slag and the molten metal has its limits does not deserve to be overlooked. Thus, the optimum working temperature falls in the range of 1250° to 1400° C.

Figure 14:
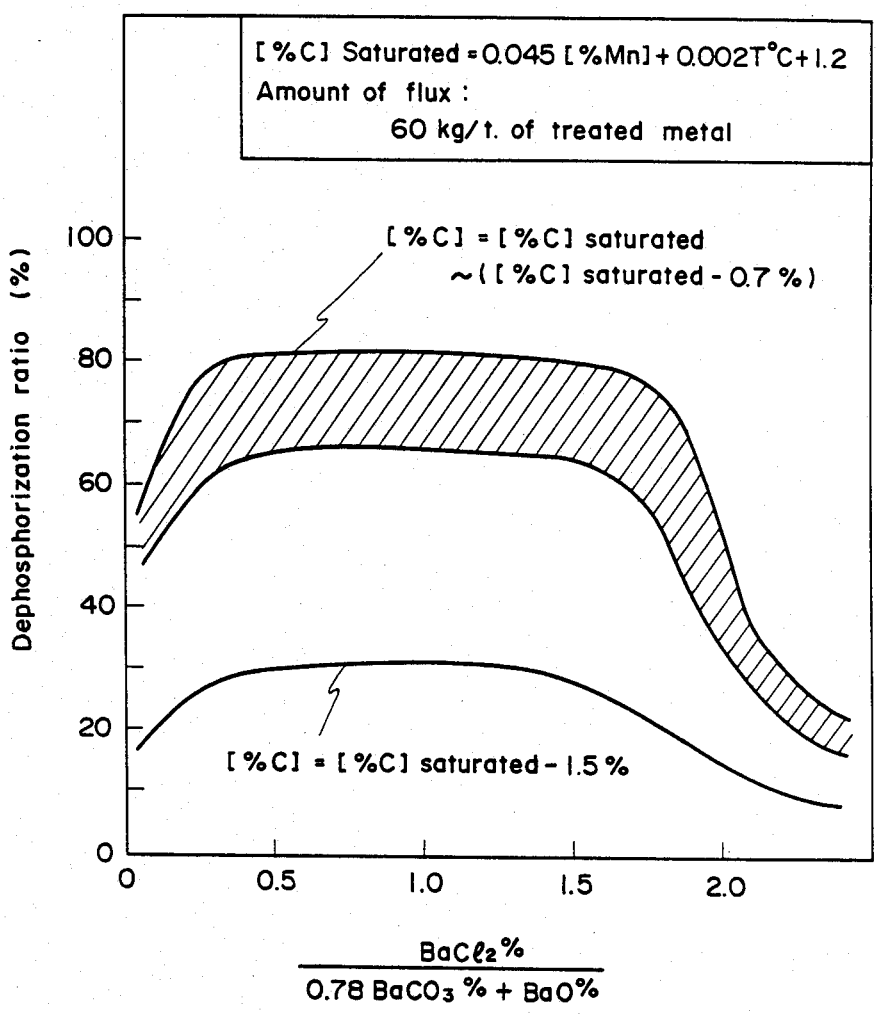
FIG. 14 is a diagram showing the effects of the composition of the slag and the compositional condition ([Mn]—[C]) of the molten alloy on the dephosphorization ratio during the course of the dephosphorization treatment by the use of a barium-based flux.

The inventors performed experiments on manganese iron alloys to determine the relation between the carbon content in the alloy and the flux composition on one part and the dephosphorization ratio on the other part. The results of the experiments are shown in FIG. 14. It is noted from the data that the dephosphorization proceeds efficiently so long as the carbon content falls within the range of saturated carbon content (%) to [saturated carbon content (%)-0.7%]. As regards the flux composition, the flux provides satisfactory dephosphorization when its composition is such that the ratio, $$\frac{BaCl_2\%}{0.78\ BaCO_3\% + BaO\ \%},$$

falls within the range of 0.2 to 2.0. If this ratio is less than 0.2, the fluidity of the slag is degraded and the efficiency of dephosphorization is lowered. If the ratio exceeds 2.0, the ability of the slag to dephosphorize the molten metal is degraded.

The amount of the flux to be added is required to fall in the range of 1 to 12%, preferably 2 to 7%. If the amount is not more than 1%, the dephosphorization ratio is insufficient. If the amount exceeds 12%, the dephosphorization efficiency is impaired because the oxidizing agent (such as, for example, the $CO_2$ produced by the decomposition of the carbonate) acts rather in the oxidation of Mn than in the oxidation of phosphorous.

In the production of a high-manganese iron alloy by the process of the present invention, the manganese oxide content in the slag to be discharged can be lowered below the level of 10%. For the purpose of further lowering the manganese oxide content and increasing the recovery ratio of manganese, it is effective to treat the formed molten slag with a molten metal or molten pig iron having a low manganese content.

In lowering the manganese oxide content in the formed slag, as previously pointed out, the equilibrated concentration of manganese oxide in the slag and the reaction rate constant pose a problem in the case of a manganese iron alloy.

The equilibrated concentration of manganese oxide in the slag represents the threshold value to which the manganese oxide content in the slag can be lowered. The reduction rate constant represents the rate of the reduction at which the manganese oxide content approaches the threshold value mentioned above. This means that even when the equilibrated concentration is low, a long time is required for lowering the manganese oxide content in the slag so long as the reaction rate is small. In the actual operation, the protracted operation has the disadvantage that the energy efficiency is lowered and the wear of refractories by fusion is increased, let alone the impairment of the productivity.

This invention, based on the discovery that the reduction rate of manganese oxide in the molten slag increases and the manganese content in the molten slag decreases in proportion as the manganese content in the molten metal decreases (FIG. 3 and FIG. 4), has adopted an operating procedure of the type which intentionally lowers the manganese content in the molten metal during the discharge of the slag and consequently enables the manganese content in the slag to be lowered in a short span of operating time. Thus, it has established a process for affording a high-manganese iron alloy advantageously, with the manganese content in the slag sufficiently repressed.

It is noted from FIG. 3 that the reduction rate constant increases as the manganese content in the molten metal falls below the level of about 20%. It is clear from FIG. 4 that the equilibrated concentration of manganese oxide in the slag sharply falls as the manganese content in the molten metal falls below the level of 20%.

Based on the discovery of such facts as described above, this invention provides a process for the production of a high-manganese iron alloy, which comprises first forming the high-manganese iron alloy in a short time, then withdrawing the high-manganese iron alloy exclusively, subsequently allowing the molten slag of a relatively high manganese oxide content which has been formed simultaneously with the aforementioned iron alloy and which has not yet reached equilibrium to undergo a contact reaction with molten pig iron, for example, thereby quickly lowering the manganese oxide content in the slag, and thereafter discharging the slag.

The slag under discussion can be disposed of by first causing the molten slag which is formed during the course of the production of the high-manganese iron alloy to be mixed with molten pig iron thereby allowing the slag to function as a deoxidizing agent for the molten pig iron, consequently causing the manganese oxide content of the slag to be lowered below 5%, and thereafter discarding the slag.

Besides, the method which alternately produces a high-manganese iron alloy and a low-manganese iron alloy is also effective in the disposal of the slag.

To be more specific, this process alternates a step for the production of a high-manganese iron alloy and a step for the discharging of slag; the former step comprising introducing a raw material consisting of manganese ore or the pre-reduction product thereof or the mixture thereof and a slag forming agent into a top and bottom blowing converter which already contains as a starting melt a molten iron alloy having a manganese content of not more than 20% by weight, feeding oxygen or an oxygen-containing gas to the aforementioned converter thereby heating, melting, and reducing the aforementioned raw material, causing the manganese content in the aforementioned molten alloy to increase beyond 40% by weight, and withdrawing part or the whole of the aforementioned high-manganese iron alloy for casting and the latter step comprising introducing a raw material consisting of an iron source such as, for example, iron ore, and a slag forming agent in combination with a carbonaceous material into the molten slag formed in the preceding step, feeding oxygen or an oxygen-containing gas into the aforementioned converter thereby heating, melting, and reducing the aforementioned raw material and giving rise to a molten alloy having a manganese content of not more than 20% by weight and consequently lowering the manganese oxide content in the slag below 10% by weight, and thereafter discharging the slag. The molten iron alloy having a manganese content of not more than 20% by weight which is formed during the latter step is utilized as starting melt for the subsequent step.

In the operation carried out as described above, the CO gas which is generated by the combustion of solid carbonaceous substance and the reduction of manganese oxide and iron oxide with the solid carbonaceous substance, on contact with the oxygen introduced by top blowing, undergoes the reaction, $2CO+O_2 \rightarrow 2CO_2$, and the heat generated by this reaction is utilized as a heat source. Thus, the process of this invention has the effect of enjoying a notably large amount of heat generated per unit amount of solid carbonaceous substance as compared with the conventional process which resorts to a blast furnace, i.e. a converter of the type using a layer of coke and relying exclusively on the reaction of $2C+O_2 \rightarrow 2CO$.

Further, the top and bottom blowing has the advantage that the reactions of heating, melting, and reducing are regulated easily by controlling the amounts of gases being introduced in the opposite directions. Further since the forced stirring of the molten metal with the bottom blow gas notably increases the reduction rate and enables the operation itself to be carried out at a relatively low temperature, the problem on the service life of refractories lining the aforementioned converter can be solved rationally.

Among the advantages of the bottom blowing are the promotion of liberation of the gas generated by the reaction from the molten metal, the repression of such adverse phenomena as slag foaming and flooding, and the elimination of local heating of raw material or molten metal and the consequent uniformization of temperature distribution.

Further, the loss of manganese due to the vaporization by local heating, a drawback heretofore accepted resignedly as an inevitable consequence of the production of a manganese type alloy by the technique of oxygen blowing, can be alleviated to a great extent by designing the bottom blowing nozzle in a triple tube construction, enabling the carbonaceous material, for example, to be bottom blown in conjunction with oxygen during the step of smelting reduction, and allowing the bottom blow gas to be switched to a gas not containing oxygen at the start of the step of finishing reduction.

As described above, the process of the present invention enables a high-manganese iron alloy of any description to be produced inexpensively and efficiently in a top and bottom blowing converters. The slag by-produced in the process has a manganese oxide content just proper for the slag to be used in its unaltered form as a fertilizer for farm crops. This invention, thus promising contributions to manufacture of high-manganese steel, reduction of steelmaking cost, and enhancement of product quality, enjoys a very high economic value.

Now, the present invention will be described more specifically below with reference to working examples.

EXAMPLE 1

A small converter having a capacity of 5 tons was used. The converter was provided at the center of the bottom thereof with a bottom blowing nozzle of a double tube construction. The raw materials used in this and following examples and their grades were as shown in Table 1.

The manganese ore used herein was thermally reduced at 1000° C. in a rotary kiln in conjunction with coke as a reducing agent. At this time, the degree of oxidation of manganese (the proportion of the oxidized manganese, calculated as tetravalent manganese, to the total manganese) was 5%. For the manganese ore so reduced preparatorily to be introduced hot into the aforementioned converter, it was transported and stored in a tightly closed container.

The aforementioned converter contained in advance therein 1000 kg of a molten high-manganese iron alloy prepared in a separate smelting furnace, with molten slag superposed in a thickness of about 150 mm on the surface of the molten metal.

TABLE I

Raw materials used and Chemical compositions thereof

| | Mn | $SiO_2$ | Fe | CaO | $Al_2O_3$ | C | $CaC_2$ | (in %) $CaF_2$ |
|---|---|---|---|---|---|---|---|---|
| Mn ore | 51 | 3 | 3 | — | 6 | | | |
| Mn ore | 41 | 5.5 | 18.5 | 3 | 0.5 | | | |
| Iron ore | | 6.5 | 58 | 0.5 | 2.5 | | | |
| Molten pig iron | | | 95 | | | 4.7 | | |
| Coke | | | | | | FC85 | | |
| Lime stone | | | | 55 | | | | |
| Quick lime | | | | 94 | | | | |
| $CaC_2$ | | | | | | | 80~90 | |
| $CaF_2$ | | | | | | | | 86 |

(Note)
Coke: Volatile matter content 2% and ash content 13%

In the meantime, oxygen was blown in through the inner tube and argon as a cooling gas was blown in through the outer tube respectively of the bottom blowing nozzle under a pressure of 3 kg/cm$^2$, each at a flow rate of 200 liters/min.

When all the preparations described above were completed, 30 kg of dry coke was thrown in the top and bottom blowing converter and oxygen was blown in via the top blowing lance at a flow rate of 7 Nm$^3$/min. under pressure of 5 kg/cm$^2$ to ignite the interior of the converter.

After the ignition was confirmed, 1000 kg of the aforementioned pre-reduced manganese ore was fed continuously and 600 kg of coke and 230 kg of lime stone were fed intermittently into the converter over a period of 90 minutes. In this while, the height of the top blowing lance and the amount of oxygen introduced by blowing were adjusted from time to time so as to keep the temperature of the molten metal in the neighborhood of 1550° C.

After the reduction of the raw materials was completed, 20 kg of coke was added, the position of the lance was raised, and the conditions of oxygen blowing were changed to 4 kg/cm$^2$ and 4 Nm$^3$/min. to effect recovery of manganese in the slag. The bottom blow gas was switched to argon and the bottom blowing of argon was continued for 15 minutes for the purpose of preventing manganese from being oxidized again. In this while, the height of the top blowing lance and the amount of oxygen introduced by blowing were adjusted from time to time to keep the temperature of the molten metal in the neighborhood of 1600° C.

The introduction of the gas through the top blowing lance was discontinued and the molten metal and the molten slag were simultaneously released onto the product bed and left cooling there. After the cooling, the metal and the slag were separated from each other, weighed and analyzed.

The weight of the metal so obtained was 1570 kg and that of the slag 490 kg. The metal, on analysis, was found to be composed of 74.7% of Mn, 0.1% of Si, 7.2% of C, and 0.15% of P. The composition indicates this metal to be a high-manganese iron alloy saturated with carbon. The slag was found to be composed of 7.8% of MnO, 0.8% of FeO, 30% of $SiO_2$, and 39% of CaO.

These results show that, of the total manganese supplied in the form of ore, 6% was contained in the slag, 4% lost by vaporization and, therefore, 90% utilized for the alloy production.

EXAMPLE 2

A molten high-manganese iron alloy saturated with carbon and molten slag were formed by following the procedure of Example 1. Then, the introduction of oxygen through the top blowing lance was discontinued, the lance was rolled up, the excess carbonaceous material was removed, about three quarters of the slag was removed, and subsequently the introduction of oxygen through the top blowing lance was started. At the same time, the argon introduced thence through the inner tube of the bottom blowing nozzle was again switched to oxygen for the purpose of retaining the temperature of the molten metal. At this point, the ignition was made readily and the decarburization was started.

The flow rate of the oxygen introduced by top blowing was 5.0 Nm$^3$/min. for the first ten minutes and 4.0 Nm$^3$/min. for the next 15 minutes. The bottom blowing was continued at a flow rate of 200 liters/min. The total amount of oxygen used for the top blowing was 113 Nm$^3$. The flow rate of oxygen blowing was suitably varied for the retention of the temperature of the molten metal. The flow rate of oxygen was kept at 5.0 Nm$^3$/min. until the temperature of the molten metal reached 1650° C., the level at which the oxidation of manganese proceeds preferentially over that of carbon. As the temperature rose to 1770° C., the introduction of oxygen by the top blowing was discontinued and the molten metal was freed of the molten slag to be readied for casting.

The weight of the metal so produced was 1430 kg. The metal readily separated from the slag, with virtually no metal mingling into the slag. The slag removed first contained 8% of manganese.

The carbon-unsaturated high-manganese iron alloy consequently produced, on analysis, was found to be composed of 76.70% of Mn, 0.10% of Si, and 1.51% of C.

The carbon content in the final product could be adjusted by regulating the final temperature reached by the molten metal. The carbon content of the product was 0.95%, for example, when the final temperature reached by the molten metal was raised to 1830° C.

As shown above, this invention enables a high-manganese iron alloy having a carbon content varied freely in a wide range to be produced easily and efficiently in a single process without use of any electric power.

EXAMPLE 3

A molten carbon-unsaturated high-manganese iron alloy was formed by following the procedure of Example 1 and Example 2. The molten slag which was formed at the same time was removed substantially in the whole amount thereof. Then, as the temperature of the remaining molten high-manganese iron alloy reached 1650° C. (on elapse of about 10 minutes including the time spent in the removal of the slag after the discontinuation of the top blowing), 60 kg of $CaC_2$ and 10 kg of $CaF_2$ (5 to 15 mm in grain size and 200° C. of temperature) were added through the top of the converter and a mixture of 40 kg of finely divided $CaC_2$ (not more than 100 μm in particle diameter) with 2 $Nm^3$ of $N_2$ gas was blown in through the inner tube of the bottom blowing nozzle of a double tube construction and 2 $Nm^3$ of $N_2$ gas for stirring was blown in through the outer tube for ten minutes. After the blowing of these materials was completed, the slag was removed and the produced metal was cast.

The carbon-unsaturated high-manganese iron alloy and the low-phosphorus high-manganese iron alloy so produced were found to have the chemical compositions shown in Table 2.

TABLE 2

Chemical composition of high-manganese iron alloy

| High-manganese iron alloy | Chemical composition (%) Mn | C | Si | P | Fe | Ratio of dephosphorization (%) |
|---|---|---|---|---|---|---|
| Carbon-unsaturated high-manganese iron alloy | 76.7 | 1.5 | 0.1 | 0.15 | Balance | — |
| Low-phosphorus high-manganese iron alloy | 76.7 | 1.5 | 0.1 | 0.01 | Balance | 93.3 |

EXAMPLE 4

A molten carbon-saturated high-manganese iron alloy was formed by following the procedure of Example 1. The molten slag which was formed at the same time was removed substantially in the whole amount thereof. Then, as the temperature of the remaining molten high-manganese iron alloy reached 1350° C., 40 kg of $BaCO_3$ and 30 kg of $BaCl_2$ were added through the top of the converter and a mixture of 30 kg of finely powdered $BaCO_3$ with 22 $Nm^3$ of $N_2$ gas was blown in through the inner tube of the bottom blowing nozzle of a double tube construction and 2 $Nm^3$ of $N_2$ gas for stirring was blown in through the outer tube of the same nozzle for ten minutes. After the blowing of the materials was completed, the slag was removed and the product was cast.

The low-phosphorus high-manganese iron alloy so produced, on analysis, was found to have the chemical composition shown in Table 3.

TABLE 3

Chemical composition of high-manganese iron alloy (in %)

| Mn | C | Si | P | Fe | Ratio of dephosphorization (%) |
|---|---|---|---|---|---|
| 74.0 | 6.9 | 0.1 | 0.03 | Balance | 80 |

EXAMPLE 5

A small converter having a capacity of 5 tons was used. This converter was provided at the center of the bottom thereof with a bottom blowing nozzle of a triple tube construction. The manganese ore, coke, and lime stone used herein were the same as those used in Example 1. Through the inner tube of the bottom blowing nozzle, a mixture of 100 g/min. of finely divided coke (not more than 0.5 mm in particle diameter) with 200 liters/min. of argon gas as a carrier gas was blown in under pressure of 3 $kg/cm^2$. Through the medium tube, oxygen gas was blown in at a flow rate of 350 liters/min. under pressure of 3 $kg/cm^2$. Through the outer tube, argon gas was blown in at a flow rate of 350 liters/min. under pressure of 3 $kg/cm^2$.

Similarly to Example 1, in the converter, 1000 kg of a molten high-manganese iron alloy prepared separately was contained in advance and molten slag was superposed in a thickness of about 150 mm on the surface of the molten metal.

First, 30 kg of coke was added and oxygen was introduced through the top blowing lance at flow rate of 7 $Nm^3$/min. under pressure of 5 $kg/cm^2$ to ignite the interior of the converter. After the ignition was confirmed, 1000 kg of pre-reduced manganese ore and 600 kg of coke were continuously fed in and 230 kg of lime stone was intermittently fed in over a period of 90 minutes. In this while, the amount of oxygen introduced by blowing and the height of the lance were adjusted from time to time to retain the temperature of the molten metal in the neighborhood of 1550° C. This adjustment was easy as compared with that in the converter using a bottom blowing nozzle of a double tube construction.

After the introduction of the manganese ore was completed, the flow rate of the oxygen introduced by top blowing was changed to 6 $Nm^3$/min. so as to retain the temperature of the molten metal at 1650° C. At this time, the introduction of the powdered coke through the inner tube of the bottom blowing nozzle was discontinued and that of the argon gas alone was continued. The introduction of the coke into the converter was continued, though at a decreased feed rate of 6 kg/min. The smelting with the blowing was continued for ten minutes. After the smelting was discontinued, the molten metal and the molten slag were discharged, with about 1000 kg of molten metal left behind in the converter. Then, part of the removed slag was returned into the converter so that the surface of the molten metal would be covered with the layer of molten slag in a thickness of about 150 mm. The molten metal and the molten slag were released into the product bed and left cooling there. After the cooling, they were separated from each other, weighed, and analyzed. Then 30 kg of coke was added to the aforementioned converter containing the molten metal and the molten slag left over from the preceding cycle, to repeat the procedure described above. The operation was performed consecutively a total of six cycles. The results are shown in Table 4.

TABLE 4

Amounts of high-manganese iron alloy and slag formed in continuous operation and chemical compositions thereof (in %)

| | Metal (kg) | Slag (kg) | Metal composition Mn | Si | C | P | Slag composition Mn | Fe | $SO_2$ | CaO | Manganese balance Metal | Slag | Loss* |
|---|---|---|---|---|---|---|---|---|---|---|---|---|---|
| 1 | 710 | 340 | 74.8 | 0.1 | 6.8 | — | 5.5 | — | — | — | — | — | — |
| 2 | 610 | 330 | 75.5 | 0.1 | 6.8 | — | 4.2 | — | — | — | — | — | — |
| 3 | 470 | 360 | 75.0 | 0.1 | 7.2 | — | 4.2 | — | — | — | — | — | — |

TABLE 4-continued

Amounts of high-manganese iron alloy and slag formed in continuous operation and chemical compositions thereof (in %)

| | Metal | Slag | Metal composition | | | | Slag composition | | | | Manganese balance | | |
|---|---|---|---|---|---|---|---|---|---|---|---|---|---|
| | (kg) | (kg) | Mn | Si | C | P | Mn | Fe | $SO_2$ | CaO | Metal | Slag | Loss* |
| 4 | 590 | 350 | 74.8 | 0.1 | 7.0 | — | 6.3 | — | — | — | — | — | — |
| 5 | 570 | 380 | 74.9 | 0.1 | 7.2 | — | 4.6 | — | — | — | — | — | — |
| 6 | 590 | 340 | 74.9 | 0.1 | 7.0 | — | 4.0 | — | — | — | — | — | — |
| 1–6 | 3540 | 2100 | 75.0 | 0.1 | 7.0 | 0.16 | 4.8 | 0.5 | 32.0 | 41.0 | 94 | 4 | 2 |

*(Loss through vaporization)

The weights of metal and slag indicated above represent the net weights obtained after the smelting by oxygen blowing.

The data on manganese balance indicate that the loss of manganese through vaporization was half the level obtained in the operation using the bottom blowing nozzle of a double tube construction (not involving the introduction of powdered coke by blowing).

EXAMPLE 6

A top and bottom blowing converter having a capacity of 10 tons was used. It was provided at the center of the bottom thereof with a bottom blowing nozzle of a double tube construction. The raw materials were the same as those shown in Table 1.

The manganese ore used herein was pre-reduced in a rotary kiln at 1000° C. in conjunction with coke as a reducing agent. At this time the degree of oxidation of manganese (the proportion of the oxidized manganese, calculated as tetravalent manganese, to the total manganese) was 5%.

In the top and bottom blowing converter, 1000 kg of a molten low-manganese iron alloy was placed and molten slag having the same composition as the flag finally discharged in the process of this invention was superposed in a thickness of about 200 mm (about 1000 kg) on the surface of the molten metal. In this case, oxygen was blown in through the inner tube nd argon as cooling gas was blown in through the outer tube respectively into the converter under pressure of 3 kg/cm$^2$, each at a flow rate of 700 liters/min.

After the preparation described above were completed, production of a high-manganese iron alloy was launched by feeding 30 kg of dry coke into the converter and blowing oxygen through the top blowing lance at a flow rate of 15 Nm$^3$/min. under pressure of 5 kg/cm$^2$ to ignite the interior of the converter. After the ignition was confirmed, the pre-reduced manganese ore was continuously fed hot into the forementioned converter and coke and lime stone were fed intermittently therein. Thus, the converter was fed with 3650 kg of manganese ore, 1500 kg of coke, and 300 kg of lime stone. In the meantime, the height of the lance and the amount of oxygen introduced by blowing were adjusted so as to keep the temperature of the molten metal in the neighborhood of 1550° C.

Then, the introduction of oxygen through the top blowing lance was discontinued and the molten metal formed in the converter was tapped substantially in the whole amount thereof, with the escape of the molten slag prevented effectively with a weir fitted to the outlet.

The step of slag treatment aimed at recovering the manganese oxide contained in the molten slag remaining in the converter was launched by starting the introduction of oxygen through the top blowing lance. In this case, the ignition was made very easily because coke was still remaining as mingled in the slag. The introduction of oxygen by blowing was carried out in a flow rate of 10 Nm$^3$/min. under pressure of 5 kg/cm$^2$. Immediately 800 kg of molten pig iron was added and 200 kg of coke and 50 kg of quick lime were intermittently added, with due attention paid to the retention of the temperature of the molten metal. After the addition of these materials was completed, forced introduction of oxygen was made for the purpose of elevating the temperature of the molten metal. As the temperature reached 1600° C., the introduction of oxygen through the top blowing lance was discontinued. Then the formed slag was discharged exclusively until the thickness of the layer of molten slag convering the molten metal decreased to about 200 mm.

In the actual commercial operation, the molten low-manganese iron alloy and the molten slag so left behind in the top and bottom blowing converter would be utilized recurrently for production of a high-manganese iron alloy.

The amounts of the high-manganese iron alloy so produced and the molten slag formed at the same time and those of the low-manganese iroin alloy and the molten slag formed at the same time and the chemical compositions thereof are shown collectively in Table 5.

TABLE 5

Amounts of metal and slag formed in one cycle of operation and typical chemical compositions thereof

| | Manganese iron alloy | | | | Slag | | | | |
|---|---|---|---|---|---|---|---|---|---|
| | Amount formed | Chemical composition (%) | | | Amount formed | Chemical composition (%) | | | |
| Step | (kg) | Mn | C | Si | (kg) | MnO | CaO | $SiO_2$ | $Al_2O_3$ |
| Step of production of high-manganese iron alloy | 2,800*1 | 62.0 | 6.9 | 0.1 | 1,950*2 | 20.1 | 29.8 | 21.0 | 25.4 |
| Step for treatment of | 1,020 | 18.3 | 6.5 | 0.1 | 1,880 | 7.0 | 36.1 | 25.7 | 27.8 |

TABLE 5-continued

| | Amounts of metal and slag formed in one cycle of operation and typical chemical compositions thereof | | | | | | | | |
|---|---|---|---|---|---|---|---|---|---|
| | Manganese iron alloy | | | | Slag | | | | |
| | Amount formed | Chemical composition (%) | | | Amount formed | Chemical composition (%) | | | |
| Step | (kg) | Mn | C | Si | (kg) | MnO | CaO | $SiO_2$ | $Al_2O_3$ |
| slag | | | | | | | | | |

*1Including 1000 kg of low-manganese iron alloy added first.
*2The amounts formed are estimates value. The chemical compositions were determined by analyzing specimens actually collected.

EXAMPLE 7

The converter and the raw materials used herein were the same as those of Example 6. The manganese content of the produced high-manganese iron alloy was fixed at about 45%.

In the converter, 1000 kg of a molten low-manganese iron alloy was placed and the slag formed in Example 6 was supported in a thickness of about 200 mm on the surface of the molten metal. The preparations were made after the manner of Example 5. Then, 3600 kg of manganese ore was continuously fed and 1500 kg of coke and 310 kg of quick lime were fed intermittently. The manganese ore of the description of Table 1 was pre-reduced and fed hot to the converter. After the introduction of oxygen by blowing was continued for a prescribed length of time, the formed molten metal was withdrawn to be cast, with about 100 kg of the molten metal left behind in the converter.

The blowing of the molten metal remaining in the converter with oxygen was started again. In this case, the ignition was made very easily as compared with that in Example 5 because the molten metal was left behind in a small amount. With the introduction of oxygen by blowing continued under the same conditions as those of Example 6, 1030 kg of iron ore, 500 kg of coke, and 140 kg of quick lime were intermittently fed and the temperature of the molten metal was elevated up to 1600° C. Thereafter, the formed slag was removed exclusively.

The amounts of metal and slag formed in the steps described above and their chemicalk compositions are shown in Table 6.

TABLE 6

| | Amounts of metal and slag formed in one cycle of operation and typical chemical composition thereof | | | | | | | | |
|---|---|---|---|---|---|---|---|---|---|
| | Manganese iron alloy | | | | Slag | | | | |
| | Amount formed | Chemical composition (%) | | | Amount formed | Chemical composition (%) | | | |
| Step | (kg) | Mn | C | Si | (kg) | MnO | CaO | $SiO_2$ | $Al_2O_3$ |
| Step of production of high-manganese iron alloy | 2,950*1 | 46.3 | 7.1 | 0.1 | 1,900*2 | 15.7 | 44.0 | 31.5 | 4.4 |
| Step for treatment of slag | 1,030 | 17.5 | 6.8 | 0.1 | 2,100 | 4.8 | 49.0 | 35.0 | 6.7 |

*1Including 1000 kg of low-manganese iron alloy added first.
*2The amounts formed are estimates value. The chemical compostions were determined by analyzing specimens actually collected.

What is claimed is:

1. A process for producing a high-manganese iron alloy from a manganese ore and/or a pre-reduced product thereof in a top and bottom blown converter type reaction vessel holding molten iron or a molten manganese iron alloy, together with a molten slag, said molten iron or alloy and said molten slag being the products of a separate smelting furnace, gas being blown into said vessel through a bottom blowing nozzle, said process comprising charging said vessel with a supply of raw materials including at least one source of manganese and iron selected from the group consisting of a manganese ore containing manganese oxide and iron oxide and a pre-reduced product thereof, a solid carbonaceous substance and a slag forming agent, while simultaneously blowing a gas selected from the group consisting of oxygen and a gas containing oxygen into said vessel through a top blowing lance to burn said carbonaceous substance so as to heat, melt and reduce said raw materials to form a melt containing manganese oxide and iron oxide; supplying an additional carbonaceous substance into said melt to reduce said manganese oxide and said iron oxide to form a molten high-manganese iron alloy and a molten slag, discontinuing said blowing of gas through said top blowing lance, and removing said molten high-manganese iron alloy and said molten slag from said vessel, said molten alloy being used for casting.

2. A process for producing a high-manganese iron alloy from a manganese ore in a top and bottom blown converter type reaction vessel holding molten iron or a molten manganese iron alloy, together with a molten slag, said molten iron or alloy and said molten slag being the products of a separate smelting furnace, gas being blown into said vessel through a bottom blowing nozzle, said process comprising charging said vessel with a supply of raw materials including at least one source of manganese and iron selected from the group consisting of a mnganese ore containing manganese oxide and iron oxide and a pre-reduced product thereof, a solid carbonaceous substance and a slag forming agent, while simultaneously blowing gas selected from oxygen and a gas containing oxygen into said vessel through a top blowing lance to burn said carbonaceous substance so as to heat, melt and reduce said raw materials to form a melt containing manganese oxide and iron oxide; supplying an additional carbonaceous substance into said melt, while blowing a gas which is free from oxygen through said bottom blowing nozzle, to reduce said manganese oxide and said iron oxide to form a molten high-manganese iron alloy and a molten slag; dicontinuing said blowing of gas through said top blowing lance; removing a part of said molten slag; blowing gas selected from the group consisting of oxygen and a gas containing oxygen into said molten high-manganese iron alloy through said bottom blowing nozzle to decarburize it by causing carbon therein to react with oxygen in said gas blown through said bottom blowing nozzle to thereby form a molten carbon-unsaturated high-manganese iron alloy; and removing said molten carbon-unsaturated high-manganese iron alloy from said vessel for casting.

3. A process for producing a high-manganese iron alloy from a manganese ore in a top and bottom blown converter type reaction vessel holding molten iron or a molten manganese iron alloy, together with a molten slag, said molten iron or alloy and said molten slag being the products of a separate smelting furnace, gas being blown into said vessel through a bottom blowing nozzle, said process comprising charging said vessel with a supply of raw material including at least one source of manganese, iron and phosphorus selected from the group consisting of a manganese ore containing manganese oxide, iron oxide and phosphorus and a prereduced product thereof, a solid carbonaceous substance and a slag forming agent, while simultaneously blowing gas selected from oxygen and a gas containing oxygen into said vessel through a top blowing lance to burn said carbonaceous substance to heat, melt and reduce said raw materials to form a melt containing manganese oxide and iron oxide; supplying an additional carbonaceous substance into said melt, while blowing gas which is free from oxygen through said bottom blowing nozzle, to reduce said manganese oxide and said iron oxide to form a molten high-manganese iron alloy and a molten slag; discontinuing said blowing of gas through said top blowing lance; removing a part of said molten slag; blowing a gas selected from the group consisting of oxygen and a gas containing oxygen into said molten high-manganese iron alloy through said bottom blowing nozzle to decarburize it by causing carbon therein to react with oxygen in said gas blown through said bottom blowing nozzle to thereby form a molten carbon-unsaturated high-manganese iron alloy; removing any existing molten slag completely from said vessel; adding a mixture of at least one of quick lime, calcium carbide and calcium silicon with a halide of an alkaline earth metal to said molten carbon-unsaturated high-manganese iron alloy; stirring said molten alloy and said mixture to dephosphorize said molten alloy to form a molten low-phosphorus high-manganese iron alloy; and removing said low-phosphorus alloy with any existing molten slag from said vessel, said low-phosphorus alloy being used for casting.

4. A process for producing high-manganese iron alloy from a manganese ore in a top and bottom blown converter type reaction vessel holding molten iron or a molten manganese iron alloy, together with a molten slag, said molten iron or alloy and said molten slag being the products of a separate smelting furnace, gas being blown into said vessel through a bottom blowing nozzle, said process comprising charging said vessel with a supply of raw materials including at least one source of manganese, iron and phosphorus selected from the group consisting of a manganese ore containing manganese oxide, iron oxide and phosphorus and a prereduced product thereof, a solid carbonaceous substance and a slag forming agent, while simultaneously blowing a gas selected from the group consisting of oxygen and a gas containing oxygen into said vessel through a top blowing lance to burn said carbonaceous substance so as to heat, melt and reduce said raw materials to form a melt containing manganese oxide and iron oxide; supplying an additional carbonaceous substance into said melt, while blowing a gas which is free from oxygen through said bottom blowing nozzle, to reduce said manganese oxide and said iron oxide to form a molten high-manganese iron alloy and a molten slag; discontinuing said blowing of gas through said top blowing lance; removing at least a part of said molten slag; adding a mixture of a barium compound selected from the group consisting of barium oxide and barium carbonate with barium chloride into said vessel; stirring the contents of said vessel to dephosphorize them to form a molten low-phosphorus high-manganese iron alloy; and removing said molten low-phosphorus alloy and any existing molten slag from said vessel, said molten alloy being used for casting.

5. The process according to claim 1, wherein said molten manganese iron alloy and said molten slag which said vessel holds prior to said charging are part of the molten high-manganese iron alloy and the molen slag which have been produced during the preceding cycle of operation of said vessel.

6. The process according to claim 2, wherein said molten manganese iron alloy and said molten slag which said vessel holds prior to said charging are part of the molten high-manganese iron alloy and the molten slag which have been produced during the preceding cycle of operation of said vessel.

7. The process according to claim 3, wherein said molten manganese iron alloy and said molten slag which said vessel holds prior to said charging are part of the molten high-manganese iron alloy and the molten slag which have been produced during the preceding cycle of operation of said vessel.

8. The process according to claim 4, wherein said molten manganese iron alloy and said molten slag which said vessel holds prior to said charging are part of the molten high-manganese iron alloy and the molten slag which have been produced during the preceding cycle of operation of said vessel.

9. The process according to any of claims 1 to 8, wherein said vessel is maintained at a temperature of 1500° C.$+\alpha$° C., where $\alpha$ is up to and includes 100° C., when heating and melting said raw materials, and when said manganese oxide and said iron oxide are reduced, a gas which is free from oxygen is blown into said melt through said bottom blowing nozzle and said vessel is maintained at a temperature of 1500° C.$+\beta$° C., where $\beta$ is up to and includes 200° C. and is at least equal to $\alpha$.

10. A process for producing a high-manganese iron alloy from a manganese ore in a top and bottom blown converter type reaction vessel holding a molten low-manganese iron alloy having a manganese content up to and including 20% by weight and a molten slag, said molten low-manganese iron alloy and said molten slag being the products of a separate smelting furnace, gas being blown into said vessel through a bottom blowing nozzle, said process comprising a stage of producing a high-manganese iron alloy and a stage of slag removal which stages are carried out alternately, said producing stage comprising the steps of charging said vessel with a supply of raw materials includng at least one source of manganese, iron and phosphorus selected from the group consisting of a manganese ore containing manganese oxide, iron oxide and phosphorus and a pre-reduced product thereof, a solid carbonaceous substance and a slag forming agent, while simultaneously blowing a gas selected from the group consisting of oxygen and a gas containing oxygen into said vessel through a top blowing lance to burn said carbonaceous substance so as to heat and melt said raw materials to form a melt containing manganese oxide and iron oxide, supplying additional carbon into said melt to reduce said manganese oxide and said iron oxide to form a molten high-manganese iron alloy having a manganese content of at least 40% by weight, discontinuing said blowing of gas through said top blowing lance, and removing a part of said molten high-manganese iron alloy from said vessel for casting, said slag removal stage comprising the steps of charging said vessel with a supply of raw materials including an iron supply, a solid carbonaceous substance and a slag forming agent, said vessel holding the rest of said molten high-manganese iron alloy and the molten slag which have been produced during said producing stage, which simultaneously blowing gas selected from the group consisting of oxygen and a gas containing oxygen into said vessel through said top blowing nozzle to burn said carbonaceous substance to heat and melt said raw materials to form a melt containing iron oxide, supplying additional carbon into said melt to reduce said iron oxide to form a molten low-manganese iron alloy having a manganese content up to and including 20% by weight and a molten slag having a manganese oxide content up to and including 10% by weight, discontinuing said blowing of gas through said top blowing lance, and removing said molten slag from said vessel.

* * * * *